US006823798B2

(12) United States Patent
Amick

(10) Patent No.: US 6,823,798 B2
(45) Date of Patent: Nov. 30, 2004

(54) TUNGSTEN-CONTAINING ARTICLES AND METHODS FOR FORMING THE SAME

(76) Inventor: Darryl D. Amick, 3227 Countryman Cir., NW., Albany, OR (US) 97321

( * ) Notice: Subject to any disclaimer, the term of this patent is extended or adjusted under 35 U.S.C. 154(b) by 0 days.

(21) Appl. No.: 10/688,071

(22) Filed: Oct. 17, 2003

(65) Prior Publication Data

US 2004/0112243 A1 Jun. 17, 2004

Related U.S. Application Data

(63) Continuation of application No. PCT/US03/02579, filed on Jan. 29, 2003, which is a continuation of application No. 10/061,759, filed on Jan. 30, 2002, now Pat. No. 6,749,802.

(60) Provisional application No. 60/423,232, filed on Nov. 1, 2002, now abandoned.

(51) Int. Cl.[7] ..... C22C 27/04

(52) U.S. Cl. ..... 102/517; 102/448; 102/503; 420/430; 86/54; 86/57

(58) Field of Search ..... 420/430; 102/448, 102/517, 501–503, 506; 86/54–55, 57

(56) References Cited

U.S. PATENT DOCUMENTS

| | | | |
|---|---|---|---|
| 1,847,617 A | 3/1932 | Löwenstein et al. | |
| 2,119,876 A | 6/1938 | Corson | |
| 2,183,359 A | 12/1939 | Smithells | |
| 2,775,536 A | 12/1956 | Fine | |

(List continued on next page.)

FOREIGN PATENT DOCUMENTS

| | | | |
|---|---|---|---|
| CA | 521944 | 2/1956 | |
| GB | 731237 | 6/1955 | |
| GB | 1514908 * | 6/1978 | ..... 102/517 |
| GB | 2149067 | 6/1985 | |
| JP | 52-68800 | 6/1977 | |
| JP | 59-6305 | 1/1984 | |
| JP | 1-142002 | 6/1989 | |
| WO | WO 00/37878 | 6/2000 | |

OTHER PUBLICATIONS

Li, C.–J., et al., "Enhanced Sintering of Tungsten–Phase Equilibria Effects on Properties," The International Journal of Powder Metallurgy & Powder Technology, vol. 20, No. 2, pp. 149–162 (Apr. 1984).

Sykes, W. P., "The Iron–tungsten System," Meeting of the American Institute of Mining and Metallurgical Engineers, New York, pp. 968–1008 (Feb. 1926).

"Steel 3–inch Magnum Loads Our Pick For Waterfowl Hunting," *Gun Tests*, Jan. 1998, pp. 25–27.

Carmichel, Jim, "Heavy Metal Showdown," *Outdoor Life*, Apr. 1997, pp. 73–78.

"Federal's New Tungsten Pellets, " *American Hunter*, Jan. 1997, pp. 19, 48–50.

*Primary Examiner*—Stephen M. Johnson
(74) *Attorney, Agent, or Firm*—Kolisch Hartwell, P.C.

(57) ABSTRACT

Manufacturing processes for articles that are formed from compositions of matter that include powders containing tungsten and at least one binder, as well as articles formed thereby. In some embodiments, the processes include compacting the mixture of powders under a first pressure to yield a desired intermediate structure, then reshaping the structure under a second pressure that is lower than the first pressure to yield the desired article. The compacting steps may include punches and/or dies having different configurations and/or materials of construction. The composition of matter preferably is selected to reflow, or be reshaped, without fragmenting or otherwise disintegrating into discrete particles or particulate. In some embodiments, the compacted intermediate structure and/or final article has an extrusion constant of less than 30,000 psi. In some embodiments, the mixture of powders has an ASTM Hall flowmeter reading for fifty grams through a cone (without tapping) of less than 18 seconds.

23 Claims, 10 Drawing Sheets

U.S. PATENT DOCUMENTS 2,919,471 A 1/1960 Heichinger
2,995,090 A 8/1961 Daubenspeck
3,123,003 A 3/1964 Lange, Jr. et al.
3,372,021 A 3/1968 Forbes et al.
3,623,849 A 11/1971 Benjamin
3,669,656 A 6/1972 Murphy et al.
3,785,801 A 1/1974 Benjamin
3,888,636 A 6/1975 Sczerzenie et al.
3,890,145 A 6/1975 Hivert et al.
3,953,194 A 4/1976 Hartline, III et al.
3,979,234 A 9/1976 Northcutt, Jr. et al.
4,027,594 A 6/1977 Olin et al.
4,035,115 A 7/1977 Hansen
4,035,116 A 7/1977 O'Brien et al.
4,138,249 A 2/1979 Rosof
4,274,940 A 6/1981 Plancqueel et al.
4,338,126 A 7/1982 Vanderpool et al.
4,383,853 A 5/1983 Zapffe
4,428,295 A 1/1984 Urs
4,488,959 A 12/1984 Agar
4,760,794 A 8/1988 Allen
4,762,559 A 8/1988 Penrice et al.
4,780,981 A 11/1988 Hayward et al.
4,784,690 A 11/1988 Mullendore
4,881,465 A 11/1989 Hooper et al.
4,897,117 A 1/1990 Penrice
4,931,252 A 6/1990 Brunisholz et al.
4,940,404 A 7/1990 Ammon et al.
4,949,644 A 8/1990 Brown
4,949,645 A 8/1990 Hayward et al.
4,960,563 A 10/1990 Nicolas
4,961,383 A 10/1990 Fishman et al.
4,990,195 A 2/1991 Spencer et al.
5,069,869 A 12/1991 Nicolas et al.
5,088,415 A 2/1992 Huffman et al.
5,264,022 A 11/1993 Haygarth et al.
5,279,787 A 1/1994 Oltrogge
5,399,187 A 3/1995 Mravic et al.
5,527,376 A 6/1996 Amick et al.
5,713,981 A 2/1998 Amick
5,719,352 A 2/1998 Griffin
5,740,516 A 4/1998 Jiranek, II et al.
5,760,331 A 6/1998 Lowden et al.
5,786,416 A 7/1998 Gardner et al.
5,814,759 A 9/1998 Mravic et al.
5,820,707 A 10/1998 Amick et al.
5,831,188 A 11/1998 Amick et al.
5,847,313 A 12/1998 Beal
5,868,879 A 2/1999 Amick et al.
5,877,437 A 3/1999 Oltrogge
5,894,644 A 4/1999 Mravic
5,905,936 A 5/1999 Fenwick et al.
5,913,256 A 6/1999 Lowden et al.
5,917,143 A 6/1999 Stone
5,922,978 A 7/1999 Carroll
5,950,064 A 9/1999 Robinson et al.
5,963,776 A 10/1999 Lowden et al.
6,048,379 A 4/2000 Bray et al.
6,090,178 A 7/2000 Benini
6,136,105 A 10/2000 Spencer
6,174,494 B1 * 1/2001 Lowden et al. ..... 419/66
6,248,150 B1 6/2001 Amick
6,270,549 B1 8/2001 Amick
6,279,447 B1 * 8/2001 Beal ..... 86/29
6,371,029 B1 4/2002 Beal
6,447,715 B1 9/2002 Amick
6,457,417 B1 10/2002 Beal
6,527,824 B2 3/2003 Amick
6,527,880 B2 3/2003 Amick
6,546,875 B2 * 4/2003 Vaughn et al. ..... 102/507
6,551,375 B2 4/2003 Siddle et al.
6,551,376 B1 4/2003 Beal
6,581,523 B2 6/2003 Beal
6,591,730 B2 7/2003 Beal
2002/0124759 A1 9/2002 Amick
2002/0152915 A1 10/2002 Vaughn et al.
2003/0027005 A1 2/2003 Elliott
2003/0161751 A1 8/2003 Elliott
2003/0164063 A1 9/2003 Elliott

* cited by examiner

Fig. 24
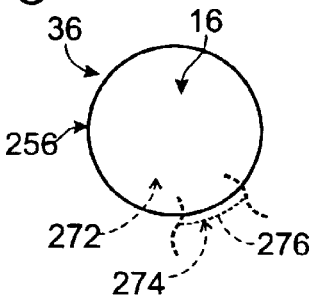
Fig. 25
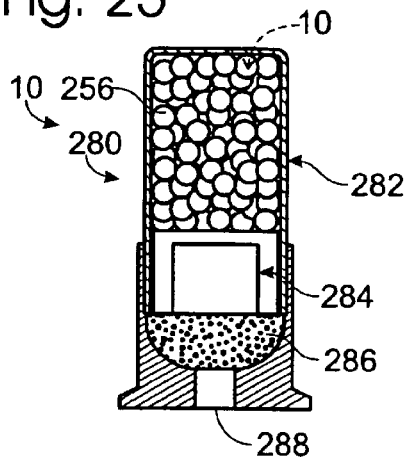
Fig. 26
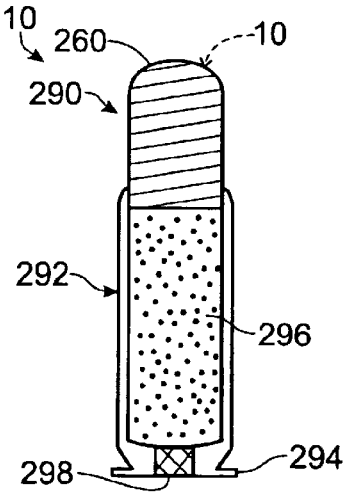
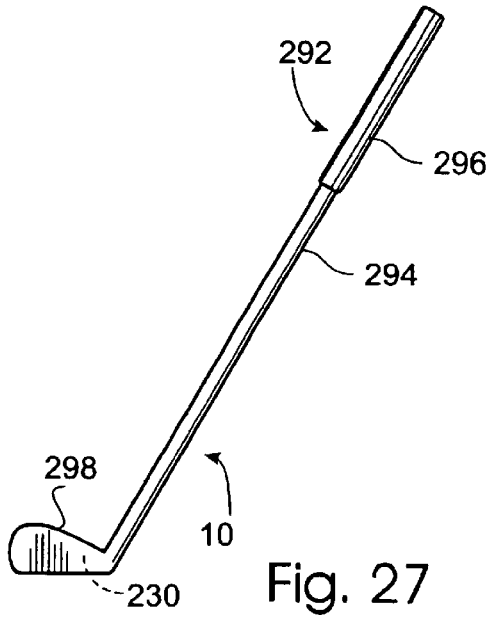
Fig. 27

TUNGSTEN-CONTAINING ARTICLES AND METHODS FOR FORMING THE SAME

RELATED APPLICATIONS

This application is a continuation of and claims priority to PCT Patent Application Ser. No. PCT/US03/02579, which was filed on Jan. 29, 2003, published in English as WO 03/065,961 on Aug. 7, 2003, and which is a continuation of U.S. patent application Ser. No. 10/061,759, which was filed on Jan. 30, 2002, now U.S. Pat. No. 6,749,802 and U.S. Provisional Patent Application Ser. No. 60/423,232, which was filed on Nov. 1, 2002. The complete disclosures of the above-identified patent applications are hereby incorporated by reference for all purposes.

FIELD OF THE INVENTION

The present invention relates generally to the field of powder metallurgy, and more particularly to articles formed from compositions of matter that include a tungsten-containing powder and at least one binder, and to methods for forming such articles.

BACKGROUND OF THE INVENTION

Conventionally, many articles have been produced from lead because of lead's relatively high density (11.3 g/cc) and relatively inexpensive cost. Examples of such articles include firearm projectiles, radiation shields and various weights. More recently, lead substitutes have been sought because of the toxicity of lead. For example, in 1996 the U.S. Fish and Wildlife Service banned the use of lead shotgun shot for hunting waterfowl. Various lead substitutes have been used, including steel and bismuth, with each offering various advantages and disadvantages as compared to lead. Other lead substitutes include tungsten or tungsten alloys.

SUMMARY OF THE INVENTION

The present invention is directed to manufacturing processes for articles that are formed compositions of matter that include powders containing tungsten and at least one binder. The manufacturing process includes compacting the mixture of powders under a first pressure to yield a desired intermediate structure, then reshaping the structure under a second pressure that is lower than the first pressure to yield the desired article. Appropriately durable tools may be used for the high-pressure compaction step, while more precise tools may be used for the lower-pressure reforming step. The composition of matter preferably is selected to reflow, or be reshaped, without fragmenting or otherwise disintegrating into discrete particles or particulate. In some embodiments, the compacted intermediate and/or final article has an extrusion constant of less than 30,000 psi. In some embodiments, the mixture of powders used to form the article have an ASTM Hall flowmeter reading for fifty grams through a cone (without tapping) of less than 18 seconds.

In some embodiments, the manufactured article contains at least one metallic binder. In some embodiments, the article contains at least one non-metallic binder, such as a polymeric binder. In some embodiments, the article contains both a metallic binder and a non-metallic binder. In some embodiments the article is a lead substitute. In some embodiments the article is a firearm projectile, such as a bullet or shot, which may be ferromagnetic or non-ferromagnetic, which may be frangible or infrangible, and which may be jacketed or unjacketed. In some embodiments, the article has a density in the range of approximately 8 g/cc and approximately 15 g/cc, with subsets of this range including densities less than the density of lead, densities selected to be equal to the density of lead or a lead alloy such as lead-antimony alloys that are commonly used in firearm projectiles, and densities selected to be greater than the density of lead, such as densities in the range of 11.5 g/cc and 15 g/cc or densities of at least 12 g/cc.

BRIEF DESCRIPTION OF THE DRAWINGS

FIG. 24 is a side elevation view of a shot pellet constructed according to the present invention.

FIG. 25 is a schematic cross-sectional view of a shotgun shell, or cartridge, containing the shot pellet of FIG. 24.

FIG. 26 is a schematic cross-sectional view of a firearm cartridge including a bullet constructed according to the present invention.

FIG. 27 is a schematic side elevation view of a golf club constructed with a golf club weight according to the present invention.

DETAILED DESCRIPTION AND BEST MODE OF THE INVENTION

Figure 1:
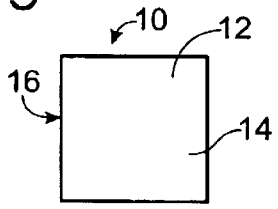
FIG. 1 is a schematic representation of an article constructed from a composition of matter according to the present invention.

FIG. 1 schematically shows an article 10, which is at least substantially or completely formed from at least one tungsten-containing component 12 and at least one binder 14. Tungsten-containing component 12 will typically be in powder form when mixed with binder 14, and accordingly will be hereafter referred to herein as tungsten-containing powder 12. Like tungsten-containing powder 12, binder 14 may also be in powder form, although some embodiments may utilize binders in nonpowder form. As used herein, the term "powder" is meant to include particulate having a variety of shapes and sizes, including generally spherical or irregular shapes, flakes, needle-like particles, chips, fibers, equiaxed particles, etc. For the purpose of simplicity, article 10 is schematically illustrated in FIG. 1 and is meant to graphically and generally represent an article 10 formed according to the present invention, with actual articles 10 constructed with virtually any desired shape and size without departing from the scope of the invention. It should be understood that much of the below disclosure is directed to firearm projectiles; however, the methods and compositions disclosed herein may be equally well suited for other articles.

DENSITY

Tungsten-containing powder(s) 12 and binder(s) 14 are mixed together to form a composition of matter 16, which is compacted to form article 10. In some embodiments, composition of matter 16 may be referred to as a non-toxic lead substitute because it has a sufficiently high density to be used to produce articles that conventionally have been formed from lead or lead alloys, but unlike lead, it is not toxic. Article 10 generally has a medium to high density and may be used for a variety of purposes, such as to form articles that conventionally have been formed from lead. As used herein, "medium-density" is meant to refer to densities in the range of approximately 8 g/cc to approximately 15 g/cc, and "high-density" is meant to refer to densities greater than 15 g/cc, such as in the range of 15 g/cc and 19.3 g/cc (the density of pure tungsten). It is within the scope of the present invention that article 10 may have a density in the range of 7.7 g/cc and approximately 18 g/cc, and preferably in the range of approximately 8.5 g/cc and approximately 15 g/cc. When article 10 is intended for use as a lead substitute, the article preferably has a density in the range of approximately 10 g/cc and approximately 13 g/cc, more preferably in the range of approximately 10.5 g/cc and approximately 12 g/cc, and even more preferably a density of approximately 11.1–11.3 g/cc (depending, for example upon whether the article will be a substitute for pure lead, which has a density of 11.3 g/cc, or a lead alloy, such as a lead-antimony alloy having a density of approximately 10.9 g/cc to 11.2 g/cc depending upon the weight percentage of antimony in the alloy).

It should be understood that article 10 may have a density outside of these illustrative ranges and within further subsets of these ranges. For example, and as discussed in more detail herein, increasing the density of article 10 typically involves at least one of increasing the weight percentage of tungsten-containing powder 12, increasing the weight percentage of tungsten within the tungsten-containing powder, and/or increasing the compaction pressure that is applied to the composition of matter to form the article or a compacted structure that is used as a component of the article.

In view of the above, in some applications it may be sufficient or even desirable to produce an article 10 that has a density that is less than the density of lead, such as a density in the range of 8 g/cc and 11.2 g/cc or a density in the range of 9 g/cc and 11 g/cc. As an example, some weights or radiation shields may be acceptable with a density that is lower than the density of lead. As another example, it may be desirable to produce a firearm projectile that has a density that exactly matches the density of a conventional lead-antimony projectile. Some articles are produced with a density that is equal to the density of lead so that the article has the same weight as a corresponding lead article of the same size.

In some embodiments, article 10 is produced with a density greater than the density of lead, such as a density in the range of 11.5 g/cc to 17 g/cc, a density in the range of 11.5 g/cc to 13 g/cc, a density of at least 12 g/cc, and a density in the range of 12 g/cc and 15 g/cc. An example of an application where a density that exceeds the density of lead may be desirable is in some firearm projectiles. Increasing the density of the projectiles will tend to increase the down-range energy of the projectiles compared to similarly dimensioned projectiles having a lower density. The higher density of such projectiles also provides the option of producing a projectile with a smaller size (in at least one dimension) while retaining the same overall weight of a comparable lead or lead-antimony projectile. The design freedom of decreasing at least one dimension of a projectile facilitates constructing projectiles with improved aerodynamics. When higher densities are used to produce more massive projectiles or more aerodynamic projectiles, such projectiles tend to better resist the influence of drag forces during flight when compared to a lead or lead-antimony projectile. In the case of more massive projectiles, the increased mass results in a greater inertia and thus greater resistance to drag forces. In the case of a more aerodynamic projectile, the drag force is reduced, and thus less influential in the trajectory, or flight path, of the projectile. In either case, the reduction in the influence of drag forces increases the down range energy of the projectile.

COMPOSITIONS

Tungsten-containing powder 12 may take a variety of forms, from powders of pure tungsten (density 19.3 g/cc), powders of a tungsten alloy, powders of more than one tungsten alloy, and combinations thereof. Examples of suitable tungsten alloys are collectively referred to as "WHA's" (tungsten heavy alloys) and typically have densities in the range of approximately 15 g/cc to approximately 18 g/cc, and often have a density of 17 g/cc or approximately 17 g/cc. In the illustrative embodiments described herein, WHA refers to an alloy including tungsten, nickel and iron, such as an alloy comprising 90–93 wt % tungsten, 5–7 wt % or more nickel, 2–3 wt % iron and possibly minor amounts of other components, such as copper, carbon, molybdenum, silicon, etc. Tungsten-containing powders 12 are especially well-suited for use in firearm projectiles, weights or other lead substitutes, because they can be mixed with less dense materials, such as binder 14, to produce a medium-density article, with a density in the ranges identified above, including densities at or near (within 0.01–0.5 g/cc) the density of lead (11.3 g/cc), lead-antimony alloys (11.1–11.2 g/cc), or densities greater than lead (12–13 g/cc or greater).

Examples of suitable tungsten alloys include, but are not limited to, W—Cu—Ni, W—Co—Cr, W—Ni—Fe, W—Ni, WC (tungsten carbide), W—Fe (ferrotungsten) and alloys of tungsten and one or more of nickel, zinc, copper, iron, manganese, silver, tin, bismuth, chromium, cobalt, molybdenum and alloys formed therefrom, such as brass and bronze. Powders formed from medium-density tungsten alloys may also be used as a suitable source of tungsten-containing powder 12. For example, other W—Ni—Fe alloys having densities in the range of 10–15 g/cc and more particularly in the range of 11–13 g/cc or approximately 12 g/cc have proven effective, although others may be used within the scope of the invention. Still further examples of suitable compositions for tungsten-containing powder 12 include powders formed from 73.64% WHA and 26.36% iron; 70% WHA and 30% zinc; 80% WHA and 20% zinc; 80% WHA, 19% zinc and 1% lubricant; 68% WHA and 32% copper; 68% WHA, 31.5% copper and 0.5% lubricant; 70% WHA and 30% tin; 70% WHA, 29.5% tin and 0.5% lubricant; 15% WHA, 21.8% tin, 63% ferrotungsten (FeW), and 0.2% lubricant; 35–40% FeW, 31% nickel, and 29–34% WHA (and optionally 0–0.5% lubricant); 50–60% WHA, 21.8% tin, 18–28% FeW, 0.2% lubricant; 40% FeW, 15% tungsten (W), 23% WHA, 21.8% tin, 0.2% lubricant; 55% W, 12.6% WHA, 10.8% FeW, 21.4% tin, 0.2% lubricant; 80% FeW, 19.75% tin, 0.25% lubricant; 29.8% W, 43.9% FeW, 26.1% tin, 0.2% lubricant; 40% W, 30% FeW, 10% WHA, 19.75% tin, 0.25% lubricant; and 71.1% FeW, 28.7% tin, and 0.2% lubricant. Unless specifically identified to the contrary, it should be understood that all composition percentages identified herein are weight percentages. The individual tungsten-containing powders may vary in coarseness, or mesh-size. Similarly, the above-presented illustrative examples that include tin may also provide examples of suitable compositions of matter 16 that include a tin-containing metallic binder, as described in more detail herein.

A particularly well-suited tungsten-containing powder 12 is ferrotungsten powder, which typically has a density in the range of 14–15 g/cc. Another suitable tungsten-containing powder is WHA powder, such as 90W7Ni3Fe (by weight) and similar compositions containing at least 80% tungsten, such as 85–95 wt % tungsten with corresponding percentages of iron and/or nickel. Further examples of suitable tungsten-containing powders 12 include tungsten-containing powders that have been high-energy milled with one or more other metallic powders to produce mechanical alloying effects, such as disclosed in U.S. Pat. No. 6,248,150, the complete disclosure of which is hereby incorporated by reference for all purposes.

Still other well-suited tungsten-containing powders 12 are powders produced from recycled tungsten or recycled tungsten alloys, such as waste materials formed when tungsten or tungsten alloys are forged, swaged, drawn, cropped, sawed, sheared, and machined. Operations such as these inherently produce a variety of metallic scrap, such as machine turnings, chips, rod ends, broken pieces, rejected articles, etc., all of which are generated from materials of generally high unit value because of their tungsten content. Illustrative processes for obtaining this powder, and compositions of such powder are disclosed in U.S. Pat. No. 6,447,715, the complete disclosure of which is hereby incorporated by reference for all purposes.

Figure 2:
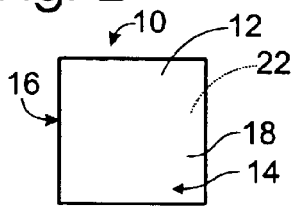
FIG. 2 is a schematic representation of an article constructed from a composition of matter that contains a metallic binder component.
Figure 3:
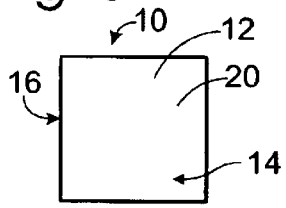
FIG. 3 is a schematic representation of an article constructed from a composition of matter that contains a non-metallic or polymeric binder component.
Figure 4:
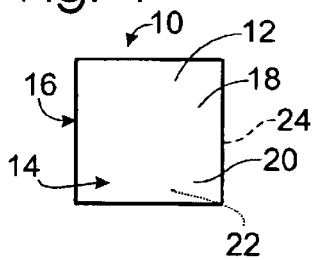
FIG. 4 is a schematic representation of an article constructed from a composition of matter that contains a metallic binder component and a polymeric or non-metallic binder component.

With the addition of binder 14, the discontinuous-phase of tungsten-containing powder 12 may be formed into a continuous-phase matrix without requiring the tungsten-containing powder to be melted. In other words, binder 14 enables the loose tungsten-containing powder to be formed into an at least relatively defined and durable shape without requiring melting and casting of powder 12. Binder 14 may include at least one of a metallic binder 18 and a polymeric binder 20. Metallic binder 18 and polymeric binder 20 also may be referred to as metallic binder component 18 and polymeric binder component 20, respectively. An example of an article 10 that includes a metallic binder component 18 is schematically illustrated in FIG. 2. In FIG. 3, an example of an article 10 that includes a polymeric binder component 20 is shown, and in FIG. 4, an example of an article 10 that includes both a metallic binder component 18 and a polymeric binder component 20 is shown.

Metallic binder 18 typically is added in powder form to tungsten-containing powder 12. The powders are then mixed and compacted during the formation of article 10. An example of a suitable metallic binder is tin-containing powder 22, as indicated graphically in FIG. 2. Tin-containing powder 22 may be pure or at least substantially pure tin powder. Tin has a density of 7.3 g/cc. Powder 22 may also include elements other than tin, such as bronze. However, in some embodiments, tin may form at least 40 wt %, and preferably at least 50 wt % of powder 22.

The weight percentage of tin-containing powder 22 in article 10 may vary depending upon such factors as the desired density of the uncompacted and the finished article, the density and amount of other components in the article, the desired strength of the article and the desired flow and ductility of the article. It is within the scope of the invention that powder 22 is present in composition 16 in the range of 5 wt % and 60 wt %. In some embodiments, powder 22 will be present in the range of 10 wt % and 50 wt %, in the range of 15 wt % and 40 wt %, and in the range of 20 wt % and 30 wt %. In some embodiments, composition 16 will contain at least 10 wt % of powder 22, in some embodiments composition 16 will contain less than 50 wt % of powder 22, in some embodiments tin-containing powder 22 will form the largest component (by particle weight percentage and/or by elemental weight percentage) in binder 14 and/or composition 16, and in some embodiments, binder 14 and/or composition 16 may be described as containing powder 22 as its majority component.

A factor that contributes to the ability of tin-containing powder 22 to form an effective binder for article 10 is tin's ability to anneal itself. In other words, tin can be cold worked, or reformed, repeatedly and still establish metallic bonding between itself and tungsten-containing powder 12.

Non-metallic, or polymeric, binder 20 may include any suitable polymeric material, or combination of polymeric materials. Examples of suitable polymeric binders include thermoplastic resins and thermoset resins, which are actuated, or cross-linked, by heating. Examples of suitable thermoset resins are melamine and powder-coating epoxies, and examples of suitable thermoplastic resins are nylon (including nylon 6), polyethylene, polyethylene glycol and polyvinyl alcohol. Other suitable polymeric binders are water-actuated polymers, such as Portland cement, vinyl cement and urea formaldehyde, which are actuated by immersion or other contact with water. Still another example of a suitable polymeric binder is a pressure-actuated polymer, such as gum arabic. Still further examples of polymeric binders that may be used are gelatin powder and stearic acid.

Particularly well-suited polymeric binders are elastomeric, or flexible, epoxies, which are thermoset resins that are suitable for use as corrosion-resistant coatings on rebar. Because rebar is often bent after being coated, its coating must bend with the rebar to provide the intended corrosion resistance. As such, these epoxies are often referred to as "rebar epoxies." Through experimentation, it has been discovered that these epoxies are particularly well-suited for use as a polymeric binder 20 for forming article 10. Examples of suitable elastomeric epoxies for use as binder 20 are sold by the 3M Corporation under the tradename 3M 413™ and by the Dupont Corporation under the trade name 2–2709™. It should be understood that other elastomeric or flexible epoxies may be used to form article 10 without departing from the scope of the invention.

Polymeric binder 20 will often comprise in the range of approximately 0.1 wt % and approximately 10 wt % of composition 16, and typically is present in the range of approximately 0.2 wt % and approximately 3 wt %. An example of a subset of this range is approximately 0.25 wt % and approximately 0.65 wt %. It should be understood that percentages outside of this range may be used; however, the amount of binder is typically rather small because polymeric (and other non-metallic) binders 20 tend to have much lower densities than tungsten-containing powder 12. Accordingly, the greater the percentage of binder 20 in composition 16, the lower the density of the resulting article compared to an article with a lesser amount of the polymeric binder. This is an important consideration to remember, especially as the desired density of article 10 increases. For example, as the amount of binder is increased, it may be necessary to use a greater amount of tungsten-containing powders having higher densities to achieve a desired density in the article formed thereby.

Illustrative, non-exclusive examples of proportions of binders that have proven effective include 1–2 wt % melamine, 1.5–5 wt % Portland or vinyl cement, 2–3 wt % urea formaldehyde, and 2–3 wt % gum arabic, with all or at least a substantial portion of the remainder of composition of matter 16 being formed from tungsten-containing powder 12. It should be understood that these exemplary proportions have been provided for purpose of illustration and that other percentages of these binders may be used. Non-exclusive examples of suitable compositions for medium-density compositions and/or articles include the following: 100 g of WHA/Fe (73.64% WHA/26.36% Fe), 161 g of WHA, 4–8 g binder; 50 g WHA/Fe (73.64% WHA/256.36% Fe), 80.5 g WHA, 4 g 3M 413™ and 0.27 g lubricant; 65.25 g WHA, 65.25 FeW (73.64% WHA/256.36% Fe), 4 g 3M 413™ and 0.27 g lubricant; 130.5 g FeW, 3.5 g 3M413™ and 0.27 g lubricant; and 116.5 g FeW, 14 g Fe, 2.4 g 3M 413™ and 0.27 g lubricant.

It is within the scope of the invention that article 10 and composition of matter 16 may include components other than tungsten-containing powder 12 and binder 14. As indicated above, the composition containing powder 12 and binder 14 may, but does not necessarily, include a relatively small component, such as below approximately 1 wt %, of a suitable lubricant 24, such as to facilitate easier removal of the bullet from a die. This is graphically illustrated in dashed lines in FIG. 4, but it should be understood that any article 10 may include lubricant 24. As discussed, article 10 and/or composition of matter 16 may be formed without a lubricant. Similarly, when the article is formed with a binder 14 that includes tin-containing powder 22, the powder may provide sufficient lubrication. Acrawax™ and Kenolube™ are non-exclusive examples of suitable lubricants.

Binder 20 may include two or more different types of polymeric or other non-metal binders. For example, a combination of a rigid epoxy and a flexible epoxy may be used to produce an article that has increased strength over a comparable article formed with only a rigid epoxy or only a flexible epoxy. When more than one binder 20 is used, it is preferable that the binders are actuated through the same or compatible mechanisms.

Another example of a suitable binder 14 for composition 16, and articles formed therefrom, is a combination of at least one metallic binder component 18 and at least one non-metallic or polymeric binder component 20. For example, binder 14 may constitute approximately 2–30 wt % of the article or composition of matter, with tungsten-containing powder constituting at least a substantial portion, if not all, of the rest of the composition of matter or article. In such an embodiment, the metallic binder component will typically constitute a majority of the binder, and may constitute as much as 70 wt %, 80 wt %, 90 wt %, or more of the binder. A benefit of binder 14 including both metallic and non-metallic binders compared to only polymeric binders is that some polymeric binders tend to swell or otherwise expand during actuation of the binder. This expansion decreases the density of the resulting composition of matter or article. However, when binder 14 also includes a metallic binder component 18, such as tin-containing powder 22, this swelling is substantially reduced or eliminated.

As an illustrative example, tin or another tin-containing powder 22 and one or more (flexible and/or rigid) thermoset epoxies have proven effective in experiments. In experiments, a composition of matter was prepared from 78.2 wt % tungsten-containing powder 12, and 21.8 wt % tin-containing powder 22. When 0.2 wt % of the tin-containing powder was replaced with epoxy and the resulting composition was actuated, the crushing strength was approximately doubled. When approximately 0.5 wt % of the tin-containing powder was replaced with epoxy, the crushing strength of the composition was approximately quadrupled. Continuing the above example for purposes of illustration, the same or similar substitutions of polymeric binder component 20 for metallic binder component 18 and/or tungsten-containing powder 12 may be used with other compositions presented herein.

Some binders 14, such as many polymeric binders 20, require actuation to achieve a desired cross-linking, curing, setting or adhesion. The particular method of actuating the binder will tend to vary depending upon such factors as the particular binder or binders being used. For example, some binders are actuated by heating. Others are actuated by hydration, and still others are actuated by compression. It should be understood that actuation may, in some embodiments, occur during a compression step, such as when heat or pressure are used to actuate the binder.

Examples of heat-actuated binders include thermoplastic resins and thermoset resins, including rebar epoxies. It has been found that heating articles, and especially smaller articles such as bullets, shot and slugs, at a temperature in the range of approximately 150° F. and approximately 445° F. for a time period in the range of 30 seconds and several hours is effective. Some compositions of matter 16 may have a greater tendency to crack as they are exposed to higher temperatures for longer periods of time, and therefore it should be understood that the temperature and time period may vary depending upon the particular composition being used. Other illustrative temperature ranges for heating of article 10 include heating at a temperature less than approximately 250° F., less than approximately 200° F., and in the range of approximately 150° F. and approximately 175° F. Similarly, heating for less than approximately 15 minutes has proven effective, such as heating for 1–15 minutes with heating for less than approximately 5 minutes being suitable for many applications. It is within the scope of the invention that other heating times and temperatures may be used, and that articles 10 may be formed without heating.

Because the particular composition of article 10 will vary depending on the particular powders and binders being used, and relative concentrations thereof, it should be understood that temperatures outside of this range may be effective for a particular article. For example, articles 10 in the form of bullets using melamine as polymeric binder 20 have been effectively cured at temperatures in the range of 340° F. and 410° F. for several minutes without cracking. It should also be noted that curing rebar epoxies at 150–175° F. for approximately 5 minutes has proven effective when these epoxies are used as the polymeric binder 20, despite the fact that these epoxies are normally cured at much higher temperatures when used as rebar epoxies.

Examples of water-actuated binders include Portland cement, vinyl cement and urea formaldehyde. Typically, the actuation step includes immersion of the articles in water, followed by a drying period. In experiments, the articles were immersed in water from between a few seconds and almost an entire day. For most water-actuated binders, an immersion, or water-compressing, period of less than an hour, and preferably less than a minute and even more preferably approximately 5–10 seconds was sufficient.

The size of the individual particles of the components of composition 16 may vary. In the context of at least firearm projectiles in which binder 14 includes tin-containing powder 22, a nominal (average) particle size of 150 mesh has proven effective for powder 22. Similarly, tin-containing powder 22 having a nominal size of 80 mesh, with no more than 75% being minus 325 mesh has also proven effective. Suitable tin-containing powder is available from Acupowder, Inc. and sold under the trade name Acu-150™. Another suitable tin-containing powder sold by Acupowder, Inc. is coarser than Acu-150™ powder and is sold under the trade name 5325™. Similarly, tungsten-containing powder 12 in the form of ferrotungsten powder having a particle size of minus 100 mesh, minus 140 mesh and minus 200 mesh has proven effective, with less than 10–12% minus 325 mesh being particularly effective. Ferrotungsten powder having a median particle size of approximately 75–125 micron has also proven effective, especially (but not exclusively) when less than 20% of the ferrotungsten powder has a particle size in the range of 45–75 micron and/or when less than 5% of the ferrotungsten powder has a particle size that is less than 75 micron. Tungsten-containing powder 12 in the form of WHA powder having a size of minus 40 mesh has proven effective. When WHA powder that is coarser than approximately 100 mesh (150 micron) is used, it preferably forms less than 20 wt % of composition of matter 16, although a greater weight percentage of this WHA powder is still within the scope of the invention. 25.4 micron tungsten powder has proven effective, although other sizes may be used and are within the scope of the invention.

It should be understood that the particle sizes presented herein are presented for purposes of illustration and not limitation. Similarly, the acceptable particle sizes may vary depending upon the particular mix and composition of powders used to form composition 16, as well as the particular shape, size and/or application of the article to be formed. For example, when article 10 is formed by filling a die with composition of matter 16, it is desirable for the non-compacted mixture of powders to have sufficient flowability to readily fill the dies that give the articles their shapes. In some embodiments, it may be desirable for the lower density powder(s) to be finer than the higher density powder(s) to discourage separation of the powders after mixing but prior to compaction. A reason for considering the flow properties of the composition of matter is that it is difficult to effectively produce articles 10 in quantity when the composition of matter is difficult to transport or otherwise dispense into the molds or dies used to form the articles. Preferably, composition of matter 16 will have an ASTM Hall flowmeter reading (for 50 grams flowing through a metal cone with no tapping) of less than 18 seconds, and even more preferably a reading of less than 16 seconds, or even less than 14 seconds.

The following table provides examples of compositions 16 and resulting densities of articles 10. The examples are presented in table-form to provide illustrative, non-limiting examples. For example, only ferrotungsten and (90W7Ni3Fe) WHA tungsten-containing powders 12 and at least essentially pure tin powder as tin-containing powder 22 are shown in the table. However, other tungsten-containing powders 12, including pure tungsten and tungsten carbide, and other tin-containing powders 22 may be used. Similarly, compositions 16 and/or articles 10 may include additional components as well, such as powders of other metals or metal alloys. For example, iron powder may be added to reduce the density of the article that otherwise would have a density greater than that of iron. Non-exclusive examples of other suitable compositions that may be used to form article 10 are disclosed in U.S. patent application Ser. No. 10/041,873, filed Jan. 7, 2002, and entitled "Tungsten-Containing Articles and Methods for Forming the Same," the complete disclosure of which is hereby incorporated by reference for all purposes.

TABLE 1

Densities of Compositions and Articles Produced from Tin- and Tungsten-Containing Powders

| W powder | FeW powder | WHA powder | Tin Powder | Lubricant | Density (g/cc) |
|---|---|---|---|---|---|
| 0 | 58 | 20 | 21.8 | 0.2 | 11–11.7 |
| 0 | 68 | 10 | 21.8 | 0.2 | 11.2 |
| 0 | 78 | 0 | 21.8 | 0.2 | 11–11.7 |
| 0 | 78 | 0 | 22 | 0 | 11 |
| 0 | 38–78 | 0–40 | 21.8 | 0.2 | 11+ |
| 0 | 0 | 68 | 31.5 | 0.5 | |
| 0 | 0 | 70 | 29.5 | 0.5 | |
| 0 | 0 | 75 | 24.5 | 0.5 | |
| 0 | 66 | 0 | 34 | 0 | 10–10.25 |
| 0 | 48–43 | 30–35 | 22 | 0 | 11.5–11.7 |
| 0 | 38–28 | 40–50 | 22 | 0 | 12 |
| 0 | 0 | 78 | 22 | 0 | 12.8–13 |
| 0 | 10 | 0 | 90 | 0 | 7.68 |

TABLE 1-continued

Densities of Compositions and Articles Produced from Tin- and Tungsten-Containing Powders

| W powder | FeW powder | WHA powder | Tin Powder | Lubricant | Density (g/cc) |
|---|---|---|---|---|---|
| 0 | 20 | 0 | 80 | 0 | 8.067 |
| 0 | 50 | 0 | 50 | 0 | 9.729 |
| 0 | 0 | 10 | 90 | 0 | 7.74 |
| 0 | 0 | 20 | 90 | 0 | 8.24 |
| 0 | 0 | 50 | 50 | 0 | 10.2 |
| 0 | 30 | 40 | 30 | 0 | 10.92 |
| 0 | 43 | 35 | 21.8 | 0.2 | 11.5–.7 |
| 0 | 43 | 35 | 22 | 0 | 11.7–11.9 |
| 0 | 63 | 15 | 21.8 | 0.2 | 11.3 |
| 0 | 18–28 | 50–60 | 21.8 | 0.2 | 12 |
| 58 | 0 | 0 | 42 | 0 | 10.58 |
| 70 | 0 | 0 | 30 | 0 | 11.55 |
| 0 | 71.1 | 0 | 28.7 | 0.2 | 10.8 |
| 0 | 80 | 0 | 19.75 | 0.25 | 11.0 |
| 55 | 10.8 | 12.6 | 21.4 | 0.2 | 11.95–12.61* |
| 29.8 | 43.9 | 0 | 26.1 | 0.2 | 12.0 |
| 40 | 30 | 10 | 19.75 | 0.25 | 12.0 |
| 15 | 40 | 23 | 21.8 | 0.2 | 11.1–11.64* |

*with compaction pressures of 50 ksi–100 ksi

Composition of matter 16 may be ferromagnetic or non-ferromagnetic, depending upon the particular compositions and weight percentages of the tungsten-containing powder 12 used to form the composition of matter. When the composition is ferromagnetic, it may be recovered using a magnet, which may be beneficial in applications in which the article is propelled away from a user during use and/or fragmented during use, such as in the context of articles in the form of firearm projectiles and fishing weights. Ferromagnetism may also be used to distinguish a ferromagnetic lead-substitute article 10 from a lead product.

SHAPE

Article 10 is formed from a composition of matter 16 that is at least substantially, if not completely, formed from tungsten-containing powder 12 and binder 14, which are combined via any suitable mechanism appropriate for tungsten-containing powder and the particular type or types of binder 14 being used. Illustrative and non-exclusive examples of suitable combination mechanisms include blenders, such as a V-cone blender, and grinding mills. When binder 14 includes a metallic binder component 18, a high-energy mill or attritor may optionally be used to obtain mechanical alloying effects, such as described in U.S. Pat. No. 6,248,150, the complete disclosure of which is hereby incorporated by reference for all purposes.

As described in detail below, forming article 10 from composition of matter 16 may include compacting the composition to form an intermediate structure having generally the desired density of the article to be produced but a different shape from the article to be produced. The intermediate structure may then be reformed, or reshaped, by compression to form an article having a shape that is different from the shape of the intermediate structure. In some embodiments, the intermediate structure and article will have the same density. In others, they will have densities that differ by less than 1 g/cc and preferably, less than 0.05 g/cc, or even less than 0.02 g/cc or 0.01 g/cc. Furthermore, in some embodiments, composition of matter 16 will be compacted directly into a desired final configuration, without first being shaped into an intermediate shape.

Figure 5:
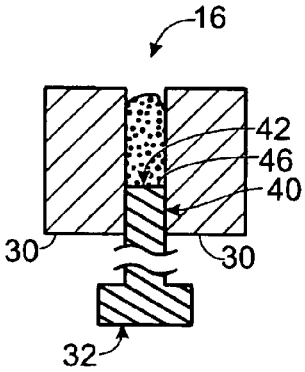
FIG. 5 is a schematic cross-sectional view of a die loaded with a mixture including a tungsten-containing powder and a binder.
Figure 6:
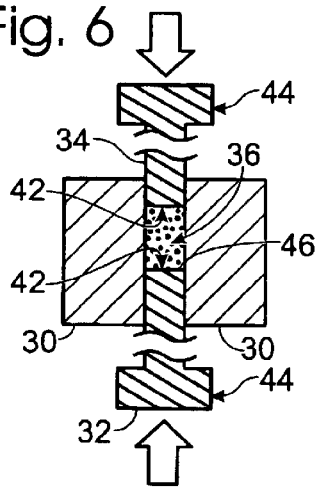
FIG. 6 is a schematic cross-sectional view of the die of FIG. 5, with the mixture undergoing compaction with upper and lower punches to form an intermediate structure.
Figure 7:
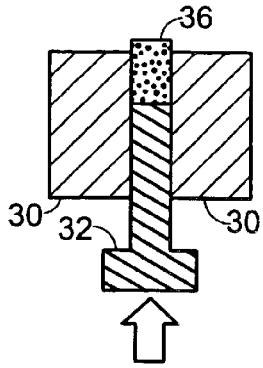
FIG. 7 is a schematic cross-sectional view of the die of FIGS. 5 and 6, with the lower punch ejecting the intermediate structure.

FIGS. 5–7 illustrate an exemplary compaction process for forming a compacted intermediate structure from a composition of matter 16 according to the present invention. In FIG. 5, a composition 16 has been placed in a first die 30 that includes a lower punch 32. After the desired amount of composition 16 has been placed in the first die, a second, or upper punch 34 is placed in position, as schematically illustrated in FIG. 6, and compacting pressure is applied to the composition to yield a compacted intermediate structure 36. In FIGS. 5–7 and many of the illustrative examples shown and described herein, intermediate structure 36 is a blank or other intermediate shape that is used to form an article in the form of a firearm projectile. However, and as also described in more detail herein, it is within the scope of the invention that the methods and compositions described herein may be used to form a variety of articles and should not be limited only to firearm projectiles.

The pressure applied during the compacting step may vary, but is typically high enough to consolidate the loose powder into a solid structure while reducing the microporosity of the composition, and concomitantly increasing the density of the composition. Although the compaction and reshaping processes are graphically illustrated as utilizing a single die with both an upper and a lower punch, this arrangement is not required, and numerous variations may be made without departing from the scope of the invention. For example, the compaction step may be accomplished with a die having a cavity with a single opening and a single punch, or a multi-piece die in combination with one or two punches, or even a multi-cavity die with multiple single- or double-acting punches. Generally speaking, the manufacturing process is simplified by using a die having a cavity with generally opposed openings and a pair of punches that are respectively adapted to be inserted into the openings.

It should be understood that the dies and punches illustrated herein are shown somewhat schematically, and that the precise shape, size and configuration of these components may vary. For example, the sizing and shape of the die and/or punches may vary depending upon the type and shape of structure or article to be produced therein, the amount of pressure to be applied, etc. As used herein, the term punch assembly will be used to refer to the punch or punches that are adapted to be inserted into a die, such as to form structure 36 or the subsequently described near final net shape or final net shape articles. Each punch may be described as having a head 40 that includes a face 42 that is adapted to contact, or otherwise compress, the composition/intermediate structure as the punch assembly is used to apply pressure, as indicated in FIG. 5. The punch or punches may be collectively referred to as constituent elements of a compaction punch assembly 44, and the faces 42 may be referred to as mixture-compressing faces, as indicated in FIG. 6. In the illustrative example shown in FIG. 6, the mixture-compressing face has a flat shape. It is within the scope of the invention that mixture-compressing faces may have other configurations, such as only substantially flat faces, concave faces, convex faces, or other faces designed to produce a desired intermediate structure 36.

Compaction and consolidation of composition 16 typically involves an applied pressure of approximately 40,000 lbs/in$^2$ or more, such as to achieve adequate consolidation of the composition and/or to achieve a desired density that is near or above the density of lead. More typically, the applied pressure is often greater than approximately 50,000 lbs/in$^2$ (psi), and in some embodiments may be greater than approximately 65,000 lbs/in$^2$, or even 75,000 lbs/in$^2$. In some embodiments, the compaction pressure may be selected to be at least 80,000 lbs/in$^2$, 90,000 lbs/in$^2$ or even 100,000 lbs/in$^2$ or higher. Compaction pressures that are less than 80,000 lbs/in$^2$, such as pressures in the range of 40,000 lbs/in$^2$ and 80,000 lbs/in$^2$, or 45,000 lbs/in$^2$ and 60,000 lbs/in$^2$, have also proven effective, especially when used to form intermediate structures with the reforming process described herein. It should be understood that there is at least some relationship between the applied compaction pressure and the density of the resulting structure. Structure 36 may be formed with essentially any selected density, depending upon the make-up of composition 16 and the amount of applied pressure. Typically, structure 36 will have a density of at least 8 g/cc, and often will have a density of at least 9 g/cc or at least 10 g/cc. For example, structure 36 may have a density in the range of 10 g/cc and 13 g/cc, a density in the range of 11 g/cc and 11.5 g/cc, a density that is equal to or near the density of lead, or a conventional lead alloy, and as a further example, that structure 36 has a density that is greater than lead, such as a density that is greater than 11.5 g/cc, 12 g/cc or more.

The following table presents illustrative examples of compacted intermediate structures 36 having a variety of densities, such as depending upon the make-up of composition 16 and the amount of applied pressure.

TABLE 2

Illustrative Compositions and Densities for Intermediate Structures at Selected Compaction Pressures

| Composition (wt %) | Density after 48300 psi | Density after 58000 psi | Density after 67600 psi | Density after 77300 psi |
|---|---|---|---|---|
| 78 FeW<br>21.8 Sn<br>0.2 wax | 11.1 | 11.1 | 11.3 | 11.3 |
| 68 FeW<br>10 WHA<br>21.8 Sn<br>0.2 wax | 11.2 | 11.3 | 11.5 | 11.6 |
| 58 FeW<br>20 WHA<br>21.8 Sn<br>0.2 wax | 11.3 | 11.4 | 11.6 | 11.7 |

After compaction (or densification), the intermediate structure typically is removed from the die, such as by removing one of the punches and ejecting the structure from the die by advancing the opposing punch 32. It should be understood that in many embodiments it is possible to remove structure 36 from either direction, depending for example upon which punch is removed first. In some embodiments, such as discussed with respect to FIG. 9, the die is configured to have structure 36 ejected from a single direction.

In order to withstand the pressures that may be required to achieve the desired density in structure 36, punches 32 and 34 may be formed from or include tungsten carbide. This is particularly true where tungsten-containing powder 12 includes ferrotungsten, which is particularly hard and abrasive. However, although tungsten carbide is very hard, it may be somewhat brittle. Therefore, in some embodiments, punches 32 and 34 are shaped so as to avoid thin edges that may fail under high compression loads. Typically, die 30 and punches 32 and 34 are configured so as to produce an intermediate structure 36 that has rotational symmetry around an axis that is coincident with the vector of the applied compression. Put another way, intermediate structure 36 is typically shaped so that it has a substantially circular cross-section along every plane orthogonal to the vector along which compression was applied.

Figure 8:
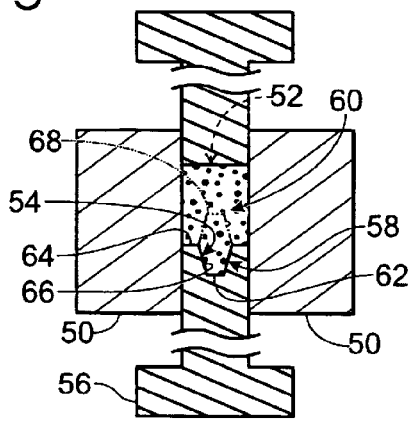
FIG. 8 is a schematic cross-sectional view of a die loaded with a mixture of powders undergoing compaction with upper and lower punches to form another intermediate structure.

As illustrated in FIGS. 5–7, die 30 and punches 32 and 34 are configured to produce an intermediate structure 36 that is at least substantially a right cylinder in shape. Die 30 defines an at least substantially cylindrical void, with punches 32 and 34 having circular faces that are flat or at least substantially flat. In FIG. 8, another illustrative die 50 is shown, with the die defining a tubular void, or cavity, 52. As also shown in FIG. 8, the face 54 of punch 56 is shaped so that the corresponding end region 58, of intermediate structure 60 includes a projecting frustoconical section 62. Thin edges, or "knife-edges" along the perimeter of the face of punch 56 are avoided by including a lip or shoulder at the base of the frustoconical section. Where such features are present, the lip or shoulder is preferably at least approximately 0.01 inches wide, and in some embodiments may be 0.02 inches wide or more.

As also shown in the illustrative embodiment shown in FIG. 8, mixture-compressing face 54 includes an edge region 64 that defines the above-described shoulder. In the illustrated embodiment, edge region 64 extends generally transverse to the direction in which the compaction pressure is applied to composition 16, but the edge region may extend generally toward or away from the other punch and/or have linear or curved configurations. As also shown in FIG. 8, face 54 includes a recess 66 internal of edge region 64. When used to form structure 60, face 54 produces an intermediate structure having a corresponding projecting region that is defined at least in part by the shape of recess 66. As indicated in dashed lines, face 54 may include an internal projection, or hollow portion, 68, in which case structure 60 would have a corresponding recess that is defined at least in part by the projection. Although only one of the punches shown in FIG. 8 includes such a shaped face 54, both punches may include faces with projections or recesses, and the face(s) may include projections or recesses with configurations other than those illustrated without departing from the scope of the invention.

Figure 9:
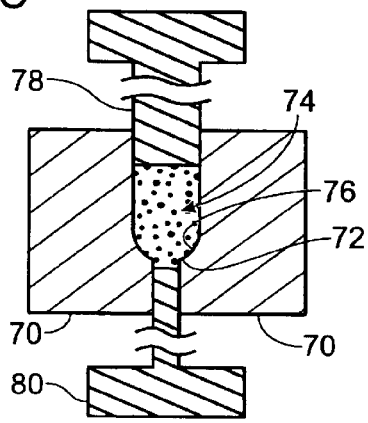
FIG. 9 is a schematic cross-sectional view of a die loaded with a mixture undergoing compaction with upper and lower punches to form still another intermediate structure.

Another example of a suitable die and compaction punch assembly is shown in FIG. 9 and demonstrates an example of a die, which itself further defines at least a portion of the desired shape of an end region 72 of the intermediate structure 74. As shown, die 70 includes a neck 76 that defines at least a portion of end region 72, which as shown takes the form of a bullet or bullet core. In the illustrative embodiment, neck 76 imparts a tapered or curved shape to end region 72, while punches 78 and 80 retain at least substantially flat faces. Such dies may be designed to produce other shapes, including structures with hollow portions, such as indicated at 68 of FIG. 8. A benefit of such a configuration is that both punches have at least substantially flat faces, which tend to be more durable and less expensive than shaped punches, and that some desired intermediate structures may include features that would otherwise require a very thin or knife-edged punch. However, die 70 may be more expensive and/or less durable than a corresponding die having cylindrical or otherwise uniform cross-sectional cavities, as shown in FIGS. 5–8.

Figure 10:
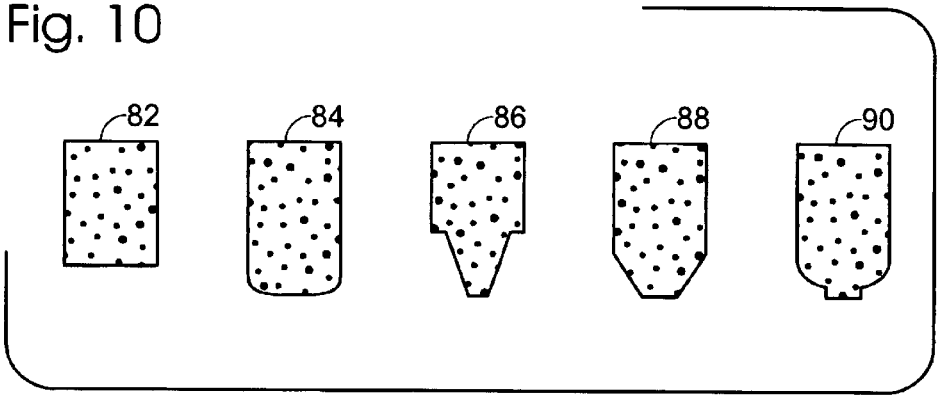
FIG. 10 is a schematic diagram showing illustrative examples of compacted intermediate structures according to the present invention.

By varying the size and shape of the die, and the shape and size of the punches (and corresponding faces), a broad variety of intermediate structures may be pressed to the desired density. FIG. 10 shows examples of such intermediate structures, including a structure 82 having a right cylindrical configuration, a structure 84 with a face that is substantially convex, a structure 86 with a face having a lip and a frustoconical section, a structure 88 having a substantially frustoconical face, and a structure 90 having a substantially convex face with an additional projection or irregularity arising from the pressing process, as provided for in FIG. 9.

Prior to placing the composition of matter into a die or other mold, the die or mold may be lubricated to facilitate easier removal of the compacted article. Any suitable die lubricant may be used. The lubricant may additionally or alternatively be mixed with the powders prior to compaction. Examples of suitable lubricants are Acrawax™ dry lubricant, Kenolube™ and stearic acid, but others may be used. Generally, the addition of a lubricant to the powders decreases the density of the compacted article. Typically, but not exclusively, non-metal lubricants are only present in less than 2 wt %, and often less than 0.5 wt % (such as 0.05–0.3 wt %).

However, article 10 may optionally be formed without the addition of a lubricant to the composition of matter and/or without lubricating the dies. More specifically, some metallic binder components, such as tin-containing powder 22, not only bind the tungsten-containing powder together, but also provide sufficient lubrication. In other words, article 10 may be produced entirely from metal powders, without requiring the addition of wax, polymers or other lubricants or non-metallic binders. Typically, tin-containing powder 22 is present in at least 10 wt % to obviate the need for a lubricant. It is also within the scope of the invention that other relatively soft metals, such as copper, may be used as a metallic lubricant and binder.

REFORMING

Once an intermediate structure having a desired density has been formed, that structure may be reshaped at a lower applied pressure into a desired article having a net final shape or near net final shape. By "net final shape," it is meant that the article has the appropriate shape for its intended use, or for assembly into a finished article, with no further machining or reshaping. By "near net final shape," it is meant that the article requires only minor working or machining in order to obtain the appropriate shape for its intended use, or for assembly into a finished article. Such minor working or machining includes, without limitation, sanding, polishing, grinding, buffing, or other finishing processes. Similarly, the drilling of cavities, threaded receivers, slots, or other fine structure in the article is also considered minor working or machining in an article of near net final shape.

When intermediate structures, such as the illustrative examples shown above in FIGS. 5–9 at 36, 60, and 74, undergo a reforming or reshaping process, the intermediate structures may also be described as being blanks, in that they may each be reformed into a variety of (near) net final shapes. Accordingly, such intermediate structures may also be described as having different shapes than the article produced during the reshaping step. For example, the article may be longer, shorter, more or less pointed, more or less curved, may have a greater or narrower shoulder, etc.

During the reshaping, or reforming, step, the pressure applied to the intermediate structure should be high enough to break and rebind the powder matrix formed during the compaction step, without any, or only minimal, loss of density or decrease in structural integrity of the desired article. Accordingly, the applied pressure for this step will tend to vary depending upon the particular configuration of the intermediate structure, the (near) net final shape of the article to be produced, the make-up of composition 16, the desired density of the article to be produced, etc. As an illustrative example, when forming a firearm projectile having a density of at least 10 g/cc, and preferably near or equal to the density of lead, the applied pressure during the reshaping step is typically greater than 25,000 lbs/in$^2$, such as in the range of approximately 35,000 lbs/in$^2$ and approximately 50,000 lbs/in$^2$, and in many embodiments is preferably greater than 45,000 lbs/in$^2$. In order to avoid the deleterious effects of extremely high pressure on the tools used, it is preferred that the reshaping pressure is less than approximately 75,000 lbs/in$^2$. The reshaping pressure will typically be less than the compaction pressure used to form the intermediate structure.

The reshaping pressure to be applied tends to vary with how close the intermediate structure is to the desired net final shape. Although an intermediate structure that is a right cylinder is preferred in terms of ease of manufacturing and stress on the punches and dies during the compacting step, a right cylinder must typically undergo comparatively more "flow" upon reshaping to produce an article having a projecting face, such as the nose of a bullet. In contrast, attempting to press an intermediate structure with a pronounced projecting face will typically require comparatively more expensive and fragile tungsten carbide punches and/or dies that incorporate thin edges or features, which often lead to earlier failure of the tools. An example of an intermediate structure that draws from the benefits of both of these approaches is a shape that is in between a right cylinder and the shape of the desired article. In the case of an article that is a bullet, such a shape typically includes a face having a conical or frustoconical surface, so that relatively less flow is required to achieve the desired shape of the final article. However, and as discussed herein, a variety of shapes may be used.

Figure 11:
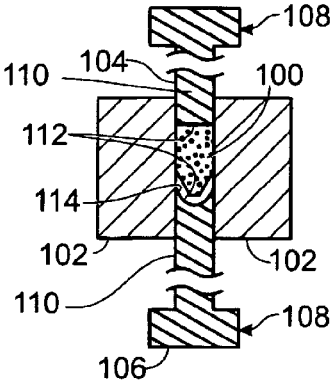
FIG. 11 is a schematic cross-sectional view of a reshaping die loaded with an intermediate compacted structure.
Figure 12:
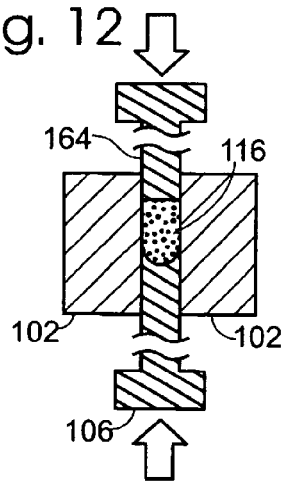
FIG. 12 is a schematic cross-sectional view of the reshaping die of FIG. 11, with the compacted intermediate structure undergoing reshaping.
Figure 13:
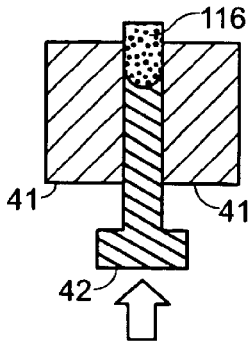
FIG. 13 is a schematic cross-sectional view of the reshaping die of FIGS. 11 and 12, with the lower punch ejecting a reshaped article.

An illustrative example of a (near) net final shape article formed by reforming an intermediate structure according to the present invention is shown in FIGS. 11–13. In FIG. 11, intermediate structure 100 is placed in die 102 with opposing punches 104 and 106. Punches 104 and 106 may collectively be referred to as constituent elements of a reshaping punch assembly 108. Similar to the above discussion with respect to compaction punch assembly 44, reshaping punch assembly 108 may include one or more punches, which each include a head 110 and a face 112 that is adapted to engage, or otherwise compress, the intermediate structure as the reshaping pressure is applied to reform the structure into an article according to the present invention. Accordingly, the faces may be referred to as structure-compressing faces. In the illustrative example shown in FIG. 11, one of the structure-compressing faces has a flat shape and the other has a concave shape with an edge region 114 that forms an acute angle with the body of the punch. Because the reshaping pressure is lower than the compaction pressure, the reshaping punch assembly may include thinner, or even knife-edged punches without experiencing, or without experiencing to the same degree, the strength and brittleness issues faced with the compaction punch assembly. In some embodiments, edge region 114 may extend generally toward or away from the other punch and may have a relatively thin thickness measured transverse to the direction upon which the punch is urged into the die. For example, edge region 114 may have a radial thickness of 0.01 inches or less, including a radial thickness of 0.005 inches, or less.

FIG. 12 shows a reshaped article 116, which is reshaped at a relatively low pressure by punches 104 and 106 from intermediate structure 100. As shown in FIG. 13, reshaped article 116 is typically dislodged from the die in a fashion similar to that of the intermediate structure, such as by advancing one of the punches to eject the article from the die. The die used in the reshaping process may be the same die used in the compaction process (although with at least one different punch), however, a different die and press is typically employed for reshaping for reasons of manufacturing efficiency. For example, the compacting die is typically equipped with a powder feed mechanism, while the reshaping die is typically equipped with a mechanism to feed the intermediate structure. Additionally, as the pressure demands of each press are substantially different, individual presses having different pressure tolerances may be used for each step. Similarly, different materials of construction may be used for the various dies and/or punches used for the compaction and reforming steps.

Figure 14:
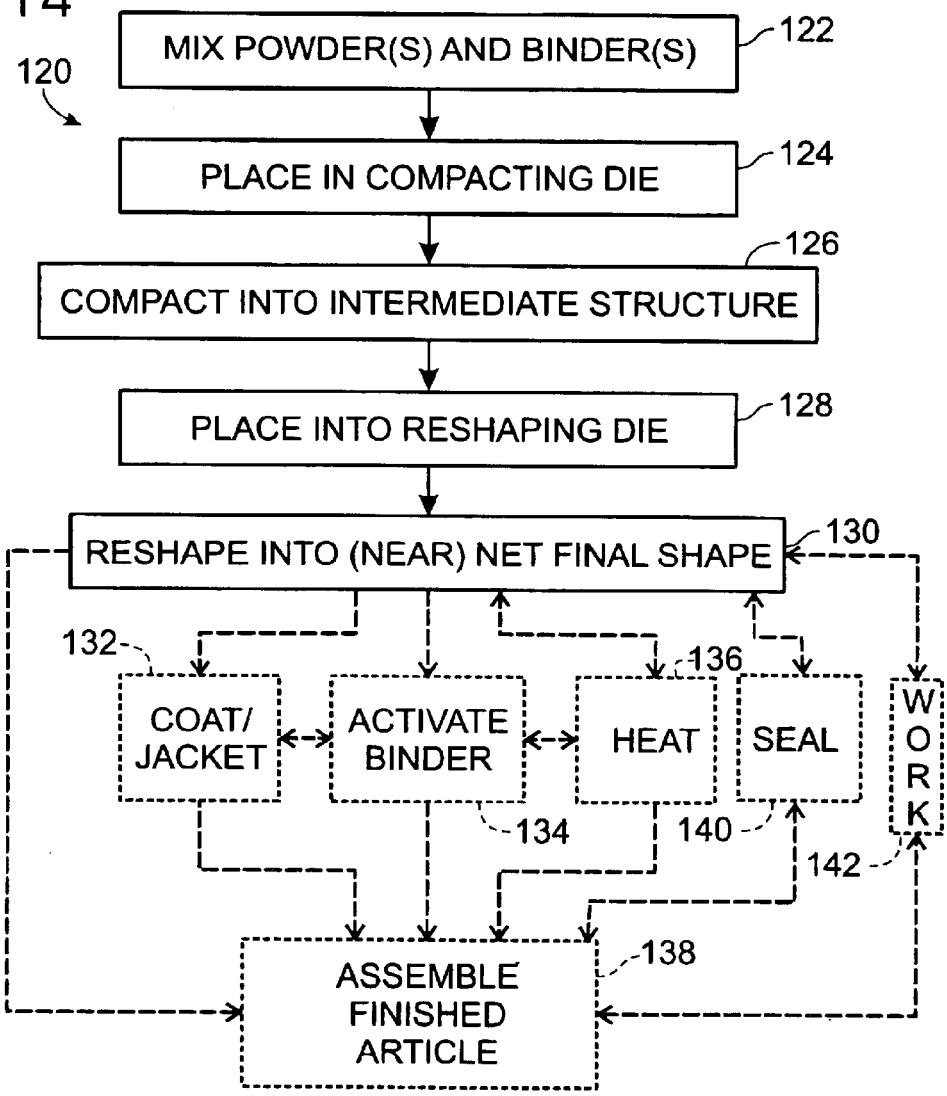
FIG. 14 is a flow chart illustrating methods for preparing the tungsten-containing articles of the present invention.

A flow chart depicting illustrative steps for forming (near) net final shape articles 116 is shown at 120 in FIG. 14. At 122, the above-described mixing step is shown. The amount of tungsten-containing powder 12 and binder 14 is selected based in part on one or more of the desired density of the finished article, the force with which the composition will be compacted, the densities of powder 12 and binder 14, and the intended application and/or processing steps for the article. For example, when tungsten-containing powder 12 contains ferrotungsten powder and tungsten heavy alloy (WHA) powder that has a higher density than the ferrotungsten powder, less of the tungsten-containing powder will be required to obtain the same density as a corresponding article made without WHA powder.

As shown at step 124 of FIG. 14, the mixed powders (composition 16) are placed into a compacting die, such as a profile die, or other suitable mold or shape-defining device or devices that defines at least substantially the desired shape of the intermediate structure and which provides a base or frame against which the powder and binder may be compressed. The composition of matter is then compressed, as indicated graphically in FIG. 14 at 126. The step of compacting into the desired intermediate structure may utilize any suitable compressive rams, punches, presses, or other pressure-imparting devices or mechanisms. Alternatively, the powders may be mixed with a lubricant, extruded and then sintered.

As shown at 128 in FIG. 14, the compacted structure is then placed into a reshaping die, which may be the same or different from the compacting die. The reshaping die at least substantially defines the desired shape of the final article and provides a base or frame against which the intermediate structure may be reshaped. The intermediate structure is then reshaped into a second structure having a net final shape, or near net final shape, as indicated graphically in FIG. 14 at 130. Compressive rams, punches, presses, or other suitable pressure-imparting devices or mechanisms may be used to reshape the intermediate structure. Reshaping typically requires less pressure than initial shaping, and therefore, a wider range of tools may be used to reshape.

In some embodiments, after reshaping step 130, article 116 has the desired net final shape for assembly into a finished article, as indicated at 138. In some embodiments, the compacted composition of matter forms a core that is coated or jacketed, as indicated at 132. For example, some bullets or other firearm projectiles are jacketed. Furthermore, it may be desirable to coat a compacted article with a metal, plastic, polymeric or other protective coating to protect the article during handling, processing and/or assembly into a finished article. As described below, and indicated at 140, the article may be sealed after compacting and/or reshaping the composition of matter. Similarly, the article may be worked, such as by being machined, grinded, polished, buffed, sanded, drilled, etc., such as indicated at 142 in FIG. 14.

The step of reshaping the intermediate structure may be accomplished without heating the intermediate structure. Additionally or alternatively, the intermediate structure may be heated, including heating to the point of annealing and/or sintering, as shown at 136. Although graphically illustrated as occurring after the compression step, one or more types of heating of the intermediate structure and/or article may occur at one or more stages within the formation process, including before, during and/or after the compression step. It also should be understood that heating is not required in some embodiments, and that articles 116 may be produced according to the present invention without requiring the composition of matter to be heated. Typically, frangible articles are not sintered, but they may or may not be heated or annealed. Sintering may be either solid-phase sintering, in which the article is heated to near the melting point of the lowest melting component, or liquid-phase sintering, in which the article is heated to or above the melting point of the lowest melting component.

It is also within the scope of the invention that any one or more of the coating, jacketing, sealing, working, heating and activating steps described herein may be performed to the intermediate structure, either in addition to or instead of one or more of these steps being performed to the near (net) final shape article. As an illustrative, non-exclusive example, an intermediate structure 16, such as may be used as a firearm projectile, may be sealed and/or coated prior to undergoing the reforming process described herein. After reforming, either or both of the sealing and/or coating steps may be repeated. However, it is also within the scope of the invention that either or both of these steps be performed only once (such as to either of the intermediate or (near) net final shape structures), or not at all.

WARM FORMING/REFORMING

Some compositions of matter may be substantially more workable when adequately heated. In particular, those compositions of matter 16 that include an epoxy component have proven to be more easily reshaped when heated. In tests, heating compositions having an epoxy component has decreased the pressure required to effectively shape and reshape the compositions. Temperatures in the range of approximately 150°–450° F. may be used when warm reforming, with temperatures of approximately 325°–350° F. proving to be effective in many tested circumstances. Warm reforming at approximately 3,000–20,000 psi can achieve the same results as cold reforming at approximately 25,000–50,000 psi. At 325°–350° F. the epoxy component of composition of matter 16 is liquefied. After the composition of matter has been reshaped, it may be allowed to cool, which allows the epoxy component to harden. As described above, a hardened epoxy may improve the strength characteristics of a resulting structure.

The ability to reshape at lower pressures when using elevated temperatures is advantageous. For example, complicated articles can be reshaped from simple intermediate structures, such as right cylinders, which can be cold compressed at relatively high pressures with relatively more robust tooling. Because the tooling for reshaping does not have to be as robust, it can be constructed from less expensive materials, such as tool steel or aluminum. The improved workability provided by warm reforming also provides the ability to form complicated shapes that may otherwise be impossible or commercially impracticable. Because reshaping may be effected at pressures even lower than those required for swaging lead alloys at room temperature, which is the standard practice for the ammunition industry, tools originally designed to work lead may be used to warm reform tungsten-containing intermediate structures.

During experiments, buckshot made from a composition including epoxy and having a 0.33 inch diameter has been flattened into a spheroid with a thickness of only approximately 0.28 inches using a pressure in the range of approximately 5,000–10,000 psi. Such a substantial amount of reshaping would take significantly more pressure if done cold. In another experiment, a composition including WHA, W, Sn, and 0.5% Dupont™ 2-2709™ was initially cold compressed into a right cylinder at approximately 80,000 ksi. The right cylinder was then reshaped at approximately 325°–350° F. and approximately 5,000–15,000 psi. The top ¼ inch of the right cylinder was reshaped so that the finished article resembled the shape of a carriage bolt, with a shaft approximately 0.492 inches in diameter and 0.6 inches in length, and a head of approximately 0.525 inches in diameter and 0.200 inches in thickness. Such a shape would be difficult, if not impossible, to cold shape. With warm reforming, however, these and other previously difficult structures may be reshaped with relatively inexpensive tooling.

EXTRUSION CONSTANT

To be reformable, the compacted composition of matter needs to be sufficiently ductile to be reshaped without crumbling or otherwise deteriorating into powder or discrete pieces. Instead, the compacted composition of matter should plastically deform while retaining its strength and structural integrity. A measure of the reformability of a composition of matter is the extrusion constant for that composition. The extrusion constant for a particular composition correlates the pressure required to extrude a first cross-sectional area of an article formed from the composition to a second cross-sectional area. Expressed in terms of cylindrical structures, the extrusion constant enables the pressure required to extrude a cylinder having a first diameter to a cylinder having a second (smaller) diameter.

More specifically, if P is the extrusion pressure in psi, A is the original cross-sectional area, A' is the extruded cross-sectional area, and k is the extrusion constant, then $$P=k\ln(A/A')$$

In experiments, the extrusion constants of various compositions, including compositions of matter 16, were compared by forming right cylinders with 0.348-inch diameters from the compositions and extruding the cylinders to a diameter of 0.156 inches. The results are summarized below:

TABLE 3

Illustrative Extrusion Constants

| Composition (wt. %) | Density (g/cc) | k (psi) |
|---|---|---|
| pure lead | 11.3 | 6,543 |
| lead alloyed with 1% antimony | 11.2 | 11,840 |
| lead alloyed with 2% antimony | 11.1 | 14,457 |
| 58% W, 42% Sn | 10.58 | 27,482 |
| 70% W, 30% Sn | 11.55 | >60,000 |
| 95% W, 5% nylon | 11.0 | >60,000 |
| 80% FeW, 19.75% Sn, 0.25% Kenolube | 11.0 | 28,982 |
| 29.8% W, 43.9% FeW, 26.1% Sn, 0.2% Kenolube | 11.2 | 18,831 |
| 40% W, 30% FeW, 10% WHA, 19.75% Sn, 0.25% Kenolube | 12.0 | 25,707 |
| 71.1% FeW, 28.7% Sn, 0.2% Kenolube | 10.8 | 19,648 |

It should be understood that the closer the extrusion constant for a particular composition is to the constant for lead, the more suitable the composition will be for reforming. From the illustrative examples shown in the preceding table, it can be seen that articles formed from compositions of matter 16 having extrusion constants of less than 30,000 psi may be desirable when the articles are to be reformed, and preferably less than 20,000 psi.

Lead reforms (or reflows or extrudes) at approximately 22–26 ksi (thousand pounds per square inch) for the reduction described above. Preferably, articles or other compacted structures formed from compositions of matter 16 according to the present invention will reform at pressures less than 50 ksi, and more preferably less than 40 ksi. It may be desirable for the articles and/or the compacted structures to have extrusion constants that deviate from the extrusion constant of lead by no more than 20%, 10%, 5%, or even that are approximately equal to that of lead. As a more particular example, an article extruded as described above and formed from 40% FeW (−100/+325 mesh), 15% W (25.4 micron), 23% WHA (−40 mesh), 21.8% Sn (Acupowder 5325™) and 0.2% Kenolube had a density of 11.08 g/cc when compacted to 50 ksi and 11.64 g/cc when compacted to 100 ksi. When the article was reformed (or extruded) as described above, it did so at an applied pressure in the range of 40–50 ksi. Furthermore, the resulting extruded article had a shear force of 40–50 pounds. As another example, an article extruded as described above and formed from 55% W (25.4 micron), 12.6% WHA (−40 mesh), 10.8% FeW (−100/+325 mesh), 21.4% Sn (Acupowder 5325™), and 0.2% Kenolube had a density of 11.95 g/cc when compacted at 50 ksi and 12.61 g/cc when compacted at 100 ksi. The article also reformed at 40–45 ksi and had a shear force of 55–75 pounds.

A benefit of an extrudable or reformable compacted structure is that the article can be initially compacted to an intermediate structure using a die assembly that is well-suited to withstand higher compaction pressures (such as a die with punches having faces that are free from knife edges, etc.). The intermediate structure can then be reshaped at the lower reforming pressure to the desired article shape.

FINAL PROCESSING (SEAL, PLATE, JACKET, ETC.)

When producing a useable article, it may be beneficial to further work a compacted and/or reshaped article, such as to improve the article's strength. Sealing, coating, plating and jacketing all tend to increase the overall strength of a compacted structure. However, as described below with reference to FIGS. 15–27, sealing increases the internal strength of the structure because the sealant is purposefully forced into the subsurface region of the compacted structure. On the other hand, coating, plating, and jacketing tend to increase the external strength of the compacted structure by providing an external cover around the structure.

Figure 15:
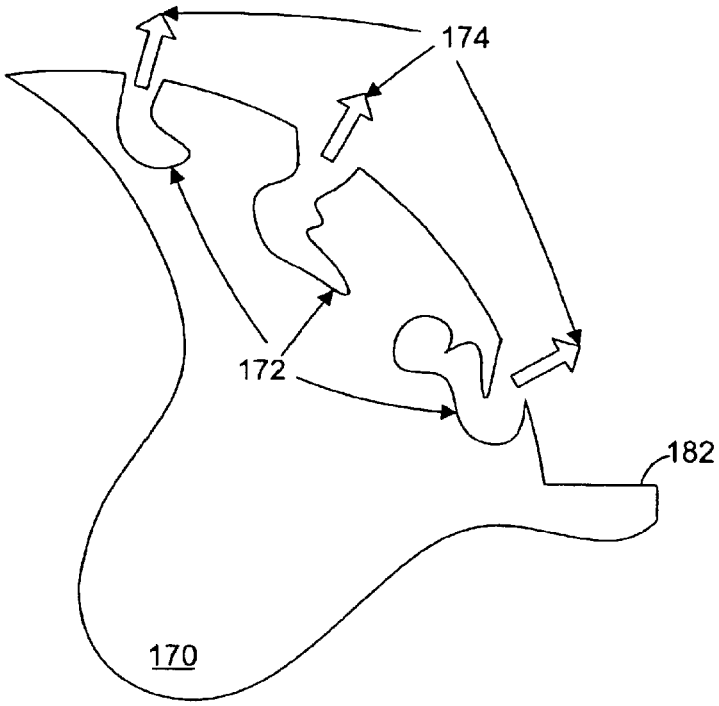
FIGS. 15–19 are schematic representations of sealing and resealing processes used to form articles according to the present invention.
Figure 16:
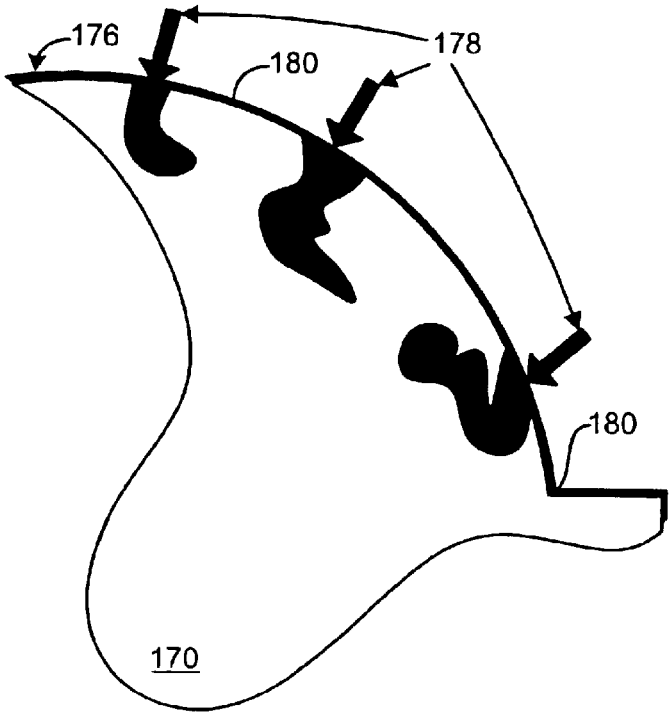

FIG. 15 provides a schematic view of a portion of a compacted intermediate structure 170, which may be further processed to form a firearm projectile or other article according to the present invention. FIG. 15 schematically shows that the intermediate structure includes pores 172, the size of which have been exaggerated to better illustrate the sealing process. A sealant may be introduced to the intermediate structure, or a group of intermediate structures, via a vacuum impregnation process. Vacuum impregnation typically includes evacuating air from the internal porosity of the intermediate structure, as is schematically illustrated by arrows 174. FIG. 16 schematically shows the introduction of a sealant 176 to the pores, which typically is accomplished by immersing one or more intermediate structures (or other compacted structures) in the liquid sealant. The evacuation of the pores creates a pressure differential that encourages the sealant to flow into the pores, as is indicated by arrows 178. A capillary effect or the application of positive pressure may further encourage flow of the sealant into the pores. As the infiltration of the sealant corresponds to a removal of air from the pores, the bulk density of the structure being sealed is increased. Furthermore, and as discussed, the sealant increases the overall strength of the structure. Because the sealant is purposefully infiltrated into the structure, it adds strength to the structure at a subsurface level.

Figure 17:
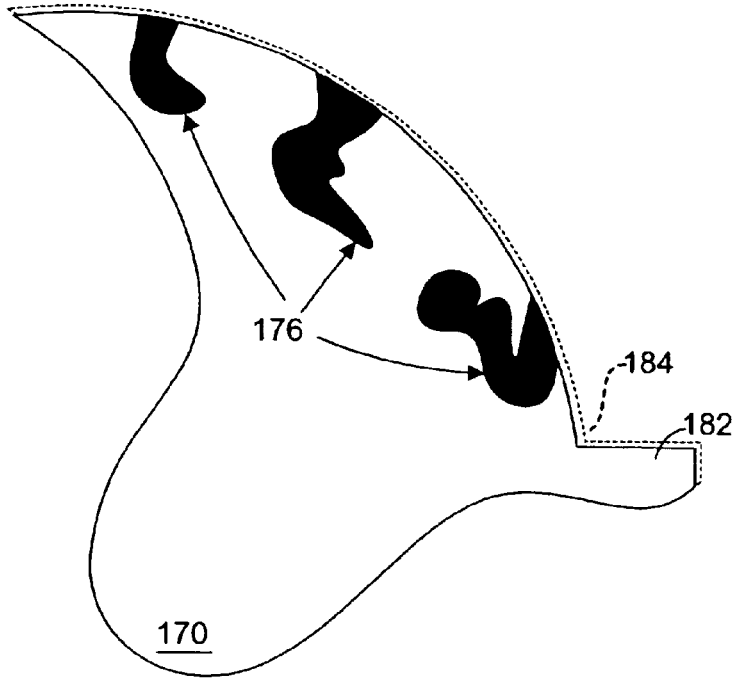

After the pores have been impregnated with sealant, the sealant is then solidified or otherwise hardened or cured. For example, in the case of a polymer sealant, the sealant is polymerized or cross-linked to form a solid polymer. In some embodiments, a catalyst bath may be used to facilitate setting the polymer. Although the sealant internally seals the pores of the intermediate structure, the structure remains at least substantially unchanged cosmetically and dimensionally. As shown in FIG. 16, the sealant may also be present in a film, or other surface layer, 180, on the structure being sealed. Film 180 may be retained to provide a surface coating, but it is often removed via any suitable process. For example, the residual coating of the illustrative polymeric sealant discussed above may be removed by rinsing the structure with water or other suitable solvents, such as depending upon the particular sealant being used. The sealant that infiltrated into the pores of the structure will remain after film 180 is rinsed away, as shown in FIG. 17. Thus, the ability of the intermediate structure to resist breaking apart during further processing is preserved even if the surface coating of the sealant is removed. When a polymeric sealant is used and the sealed structure is to be plated, the surface coating of sealant should be removed prior to plating the structure.

Vacuum impregnation may not be appropriate for some sealants, and other sealing techniques may be implemented when appropriate. Similarly, other curing or solidification techniques may be used. For example, heat curing or water curing may be desirable when using certain sealants and/or compositions 16.

In the graphical examples shown in FIGS. 15–17, the sealing process is illustrated with respect to an intermediate structure 170 that includes a projecting portion 182. Such a portion may be a byproduct of the initial compaction process, for example. Further processing of the intermediate structure may include removing or reshaping the portion from the sealed intermediate or (near) net final shape structures, or other similar physical changes. For example, any suitable grinding process may be used to at least partially, and preferably completely, remove the portion or other undesirable portion of the intermediate structure. Similarly, the above discussed reforming process may be used to alter the shape of the projecting portion, urge the projecting portion into the body of the intermediate structure, etc. Because the structure has been sealed prior to this grinding or other material-removing step, the sealed structure is much stronger and able to withstand the forces imparted thereto during this process. For example, many unsealed intermediate structures formed from compositions of matter 16 may fracture or otherwise break into pieces when ground or otherwise worked to remove the band. However, the internal, or subsurface, strength provided by the sealing step enables the intermediate structures to be ground and retain structural integrity.

Figure 18:
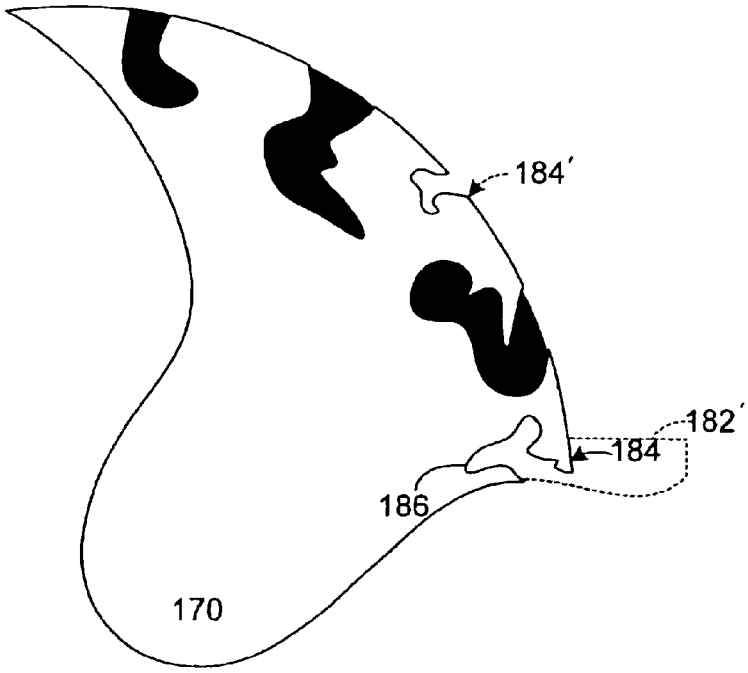
Figure 19:
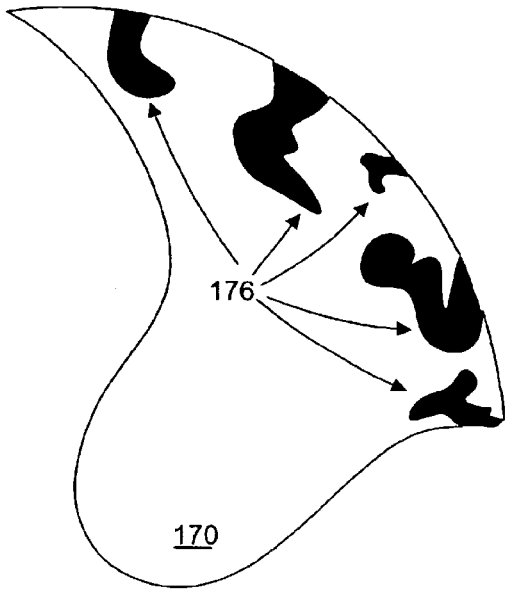

In FIG. 18, the illustrative intermediate structure 170 from FIG. 17 is shown with portion 182 removed. As shown, removal of the portion exposes a region, or surface, 184 of the structure that was not previously exposed to the sealant, and as schematically illustrated in exaggerated size, this region may include pores 186 that were not sealed during the first sealing step because of the presence of the portion. Although a grinding process, when used, preferably only removes portion 182 or any other undesirable portion of the intermediate or other compacted structure, some grinding processes may not be adapted for precise removal of only these portions and may therefore remove some material from other regions of the structure. Accordingly, additional unsealed surfaces and/or pores may be exposed during some implementations of the grinding step. Similarly, reshaping the intermediate structure may also expose pores or other voids that may be filled by thereafter (re)sealing the structure. This is schematically illustrated in dashed lines in FIG. 18 at 184' and 186'.

It is within the scope of the invention to proceed directly to a plating and/or assembly step after the compaction, sealing and/or grinding steps are completed. However, it is also within the scope of the invention to reseal the intermediate or other compacted structure after the grinding step. For example, in FIG. 19, the intermediate structure 170 from FIG. 18 is shown after being resealed. As shown, pores previously exposed during grinding have been sealed, thus increasing the strength of the structure. This second sealing process may be identical to the previously described sealing process. However, it is also within the scope of the invention that a different sealing process may be used, such as to use a different sealant, a different mechanism or different conditions for applying or infiltrating the sealant, etc.

Figure 20:
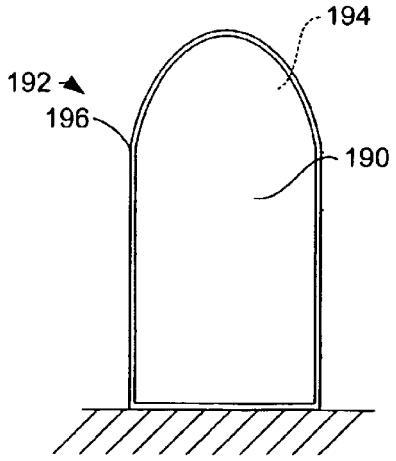
FIG. 20 is a schematic elevation view of a bullet plated according to the present invention.
Figure 21:
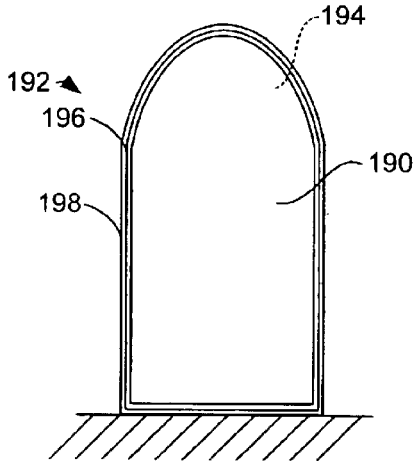
FIG. 21 is a schematic elevation view of a bullet plated and jacketed according to the present invention.

Articles made according to various embodiments of the present invention may be plated. As one non-limiting example, FIG. 20 shows an article in the form of a core 190 for a bullet 192 made with composition of matter according to the present invention, which as discussed may be a non-toxic lead substitute 194. Core 190 has been plated with a layer of plating material 196. FIG. 21 shows that bullet 192 may also be jacketed with a jacket 198. It should be understood that bullet 192 is provided as one example of the many possible articles that may be plated according to the present invention. Furthermore, it should be understood that plating may be performed in addition to sealing or in the absence of sealing. Therefore, articles according to the present invention may be any combination of sealed, plated, and jacketed.

Plating typically includes exposing bullet core 190, or any other article made according to the present invention, to a molten or other non-solid plating material and allowing the molten material to solidify on the core as plating layer 196. For example, the plating material may be introduced to the core by submerging the core in a volume of the molten plating material, spraying the molten material onto the core, electroplating the core, or other suitable methods. Copper is an example of a suitable plating material, although other materials, including copper alloys, may be used. The thickness of the plating layer may be selected according to its intended purpose. For example, a relatively thin flash plating layer, such as a layer having a thickness of 3 millimeters or a thickness of less than 5 millimeters, may be applied to increase the strength of the bullet and to provide a protective layer thereto. However, it is also within the scope of the invention to apply thicker plating layers. For example, some firearm barrels include rifling that extends into the barrels and imparts spin to a bullet when the bullet is propelled through the barrel. When core 190 is intended for use in such a barrel, the plating layer may be applied to have a thickness that exceeds the height of the rifling so that the plating layer (and not the core) interacts with the rifling. Rifling typically is approximately 5-millimeters in height, so a plating layer 196 in the range of approximately 5–8 millimeters or more in thickness has proven effective. In such an application, the plating layer itself forms what otherwise may be referred to as a jacket around the core. It should be understood that the above are only examples of the many plating methods and arrangements that are within the scope of the invention, and should not be considered as limiting. Other plating materials, methods of plating, and plating thicknesses may be used.

Bullet 192 may additionally or alternatively include a jacket 198, as shown in FIG. 21. In such an embodiment, bullet 192 may be referred to as a jacketed bullet, and jacket 198 may be described as at least substantially, if not completely, enclosing a core 190 formed at least substantially from composition of matter 16. Because bullets are commonly expelled from firearms at rotational speeds greater than 10,000 rpm, the bullets encounter significant forces. When the bullet is formed from powders, there is a tendency for these rotational forces to remove portions of the bullet during firing and flight. Jacket 198 may be used to prevent these forces from fragmenting, obturing (deforming on account of fragmenting), and/or dispersing the core during flight.

Jacket 198 may partially or completely enclose the bullet core. For example, it is within the scope of the invention that jacket 198 may completely enclose the bullet core. Alternatively, the jacket may only partially enclose the core, thereby leaving a portion of the core not covered by the jacket. For example, the tip of the bullet may be unjacketed.

Jacket 198 may have a variety of thicknesses. Typically, jacket 198 will have an average thickness of approximately 0.025 inches or less, including an average thickness of approximately 0.01 inches or less. Accordingly, it should be understood that the depicted thickness of the jacket and relative thickness of the jacket compared to the overall shape and size of the bullet is not drawn to scale.

An example of a suitable material for jacket 198 is copper, although other materials may be used. For example, jacket 198 may be additionally or alternatively formed from one or more other metallic materials, such as alloys of copper like brass, a ferrous metal alloy, or aluminum. As another example, jacket 198 may be formed from an alloy of copper and zinc (such as approximately 5% zinc) when the projectiles are designed to be higher velocity projectiles, such as projectiles that are designed to travel at speeds of at least 2,000, 2,500 or more feet per second. Jacket 198 may also be formed from a non-metal material, such as a polymer or a plastic. An example of such a material is nylon. When jacket 198 is formed from metallic materials, the bullet may be formed by compressing the powder and the binder in the jacket. Alternatively, the bullet core may be formed and thereafter placed within a jacket. As another example, the bullet core may be formed and then the jacket may be applied over the core by electroplating, vapor deposition, spray coating or other suitable application methods. For non-metallic jackets, dip coating, spray coating and similar application methods have proved effective.

When designed for use with rifled barrels, a jacketed bullet according to the present invention preferably has a jacket thickness that exceeds the height of the rifling. Otherwise, it may be possible for the rifling to cut through the jacket and thereby expose the bullet core. This, in turn, may affect the flight and performance of the bullet, as well as increase fouling of the barrel. A jacket thickness that is at least 0.001 inches, and preferably at least 0.002 to 0.004 inches thicker than the height of the rifling lands has proven effective. For most applications, a jacket 198 that is at least 0.005 inches thick should be sufficient. In firearms, such as shotguns, that have barrels with smooth (non-rifled) internal bores, a thinner jacket may be used, such as a jacket that is 0.001–0.002 inches thick. However, it should be understood that it is not required in these applications for the jacket to be thinner and that thicker jackets may be used as well.

When a jacketed article is to be formed, it is possible to place a composition of matter 16 into the jacket (such as jacket 198) prior to compressing the composition of matter. For example, powder 12 and binder 14 may be mixed and then added to the jacket, which may subsequently be placed into a die. Alternatively, the jacket may be placed into a die or other suitable mold, and then the composition of matter may be added.

Figure 22:
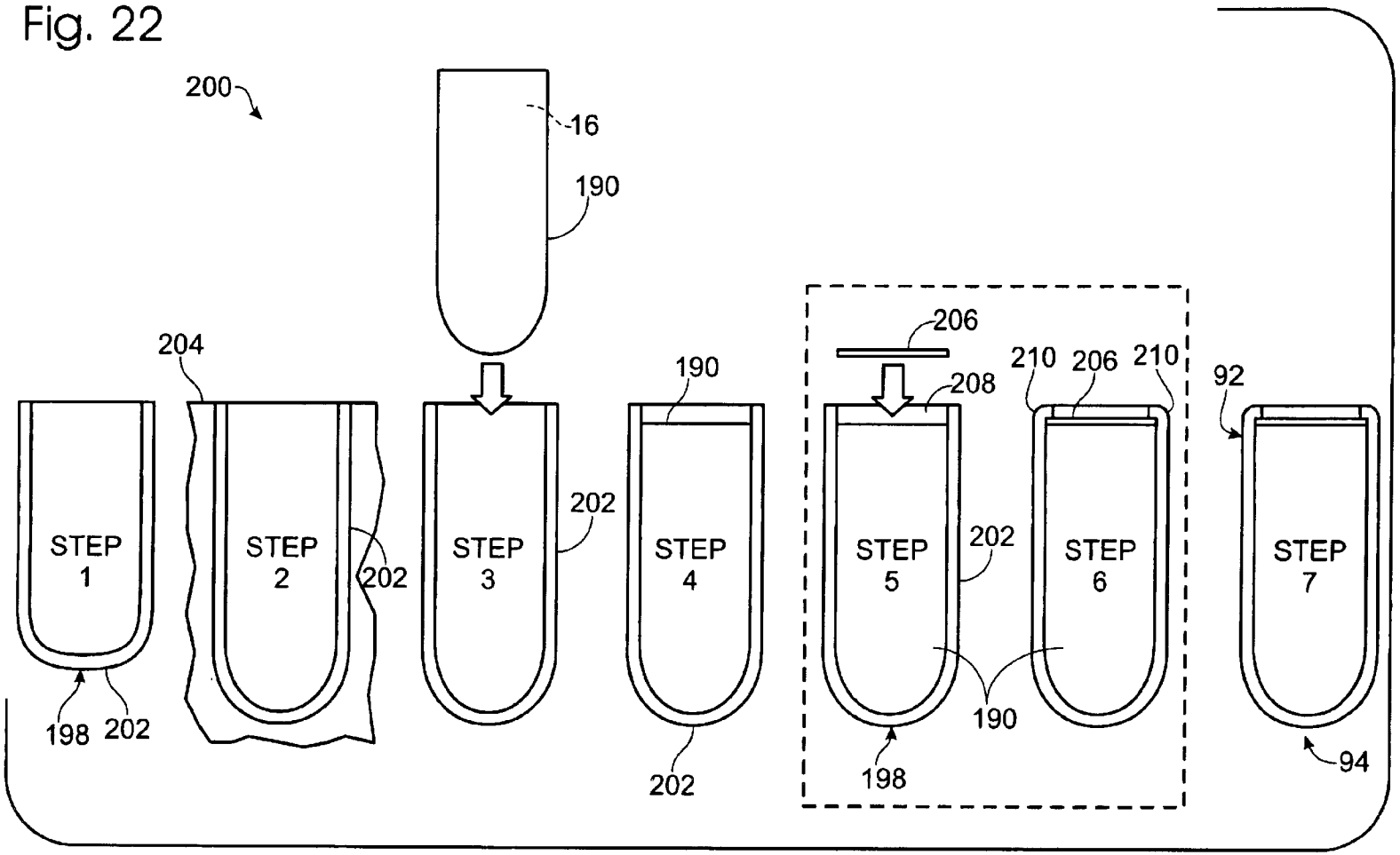
FIG. 22 is a diagram illustrating an example of a method for forming a jacketed bullet according to the present invention.

In FIG. 22, an example of a suitable method for forming an article 10 in the form of a jacketed bullet is shown and generally indicated at 200. In the illustrated example, jacket 198 starts as a body 202 of a pinch-trimmed jacket that is placed into a die 204 and subsequently shaped to a point-form jacket. A core 190 formed at least substantially from composition of matter 16 is inserted into body 202. Alternatively, an uncompacted composition of matter 16 is added to the jacket, and then subsequently compressed, and in some embodiments heated and/or actuated. The jacket is then sealed.

A retainer disk 206 is placed over the opening 208 of jacket body 202, and then the ends 210 of the point-formed jacket are crimped around the disk to enclose core 190. It should be understood that FIG. 22 is provided as an illustration of one suitable method, but other suitable methods may be used.

ARTICLES

Article 10 may itself form a finished article, meaning that the article is ready for use or sale without additional processing of the article itself. Alternatively, article 10 may be described as forming a component or region of a finished article and/or receive an additional processing step before being a finished article or finished component. For example, article 10 may itself form a firearm projectile according to the present invention. Examples of such projectiles include bullets, shot, with examples of shot including shot slugs and shot pellets. As used herein, the term "shot" refers to projectiles that are fired from a conventional shotgun or similar firearm and which are typically fired from a shot cartridge that includes a metallic base and a non-metal hull, or shell, within which a single shot slug or a plurality of shot pellets are housed. Shot shells or shot cartridges typically exhibit comparably lower pressures when fired than bullet cartridges.

These projectiles may also be described as components of other articles, namely, shot shells (which may also be referred to as shotgun cartridges) and other firearm cartridges, such as bullet cartridges. As a further alternative and example, article 10 may form a core for a bullet or shot, and this core may be jacketed or otherwise coated or encased in a covering material and/or sealed on a subsurface level prior to forming one type of finished article, and the jacketed/coated/sealed core may thereafter also be incorporated into a shot shell or firearm cartridge to form another type of finished article.

As another example, article 10 may form a finished article in the form of a golf club weight according to the present invention, either in its original form or after being coated or otherwise jacketed or encased in a protective coating or shell. Similarly, the golf club weight may be incorporated into another type of finished article, namely a golf club. As another example, a fishing weight may be entirely formed from composition of matter 16 or may have a coated or jacketed core that is formed from the composition of matter. Furthermore, the weight/core may include mounts to secure the weight to a fishing line, leader, swivel or the like and/or may be a component that is inserted into or otherwise forms a portion of the finished weight, such as by being inserted into a housing or body. As still another example, an article may have a body that is formed from composition 16 but which also includes ribs or other partitions or supports that extend through the body and which are formed from other materials.

Article 10 may take a variety of forms, including being used to form articles that conventionally have been produced from lead or lead alloys. For example, many lead weights are formed from essentially pure lead, which has a density of 11.3 g/cc. As another example, some firearm projectiles, such as 0.22 bullets may be formed from pure lead, but most are formed from an alloy of lead and a comparatively small weight percentage of antimony. Illustrative densities of these lead-antimony alloys include 11.2 g/cc (lead with 1–2 wt % antimony), 11.1 g/cc (lead with 3–4 wt % antimony), or 10.9 g/cc (lead with 6 wt % antimony). However, unlike lead or lead alloys, article 10 is preferably formed from non-toxic (at least in the concentration and composition present in article 10), environmentally safe components. Articles constructed according to the present invention are preferably lead-free. For example, lead-free articles may be desirable in any application where the lead-based articles pose contamination risks, such as for ground or water contamination. Examples of these situations include water-related activities such as bird hunting and fishing, and land-based activities such as other hunting or target shooting applications where the discharged (fired) projectiles may remain in the environment. These applications include outdoor applications, such as outdoor shooting ranges and sport hunting applications, as well as indoor applications, such as indoor practice or target-shooting ranges. Although in some embodiments, articles 10 and/or composition of matter 16 are lead free, it is also within the scope of the invention to produce articles or compositions of matter that include some lead so long as the lead component does not raise the toxicity of the article or composition of matter beyond an acceptable level, such as may be established by state, federal, or other regulatory or advisory agencies.

Figure 23:
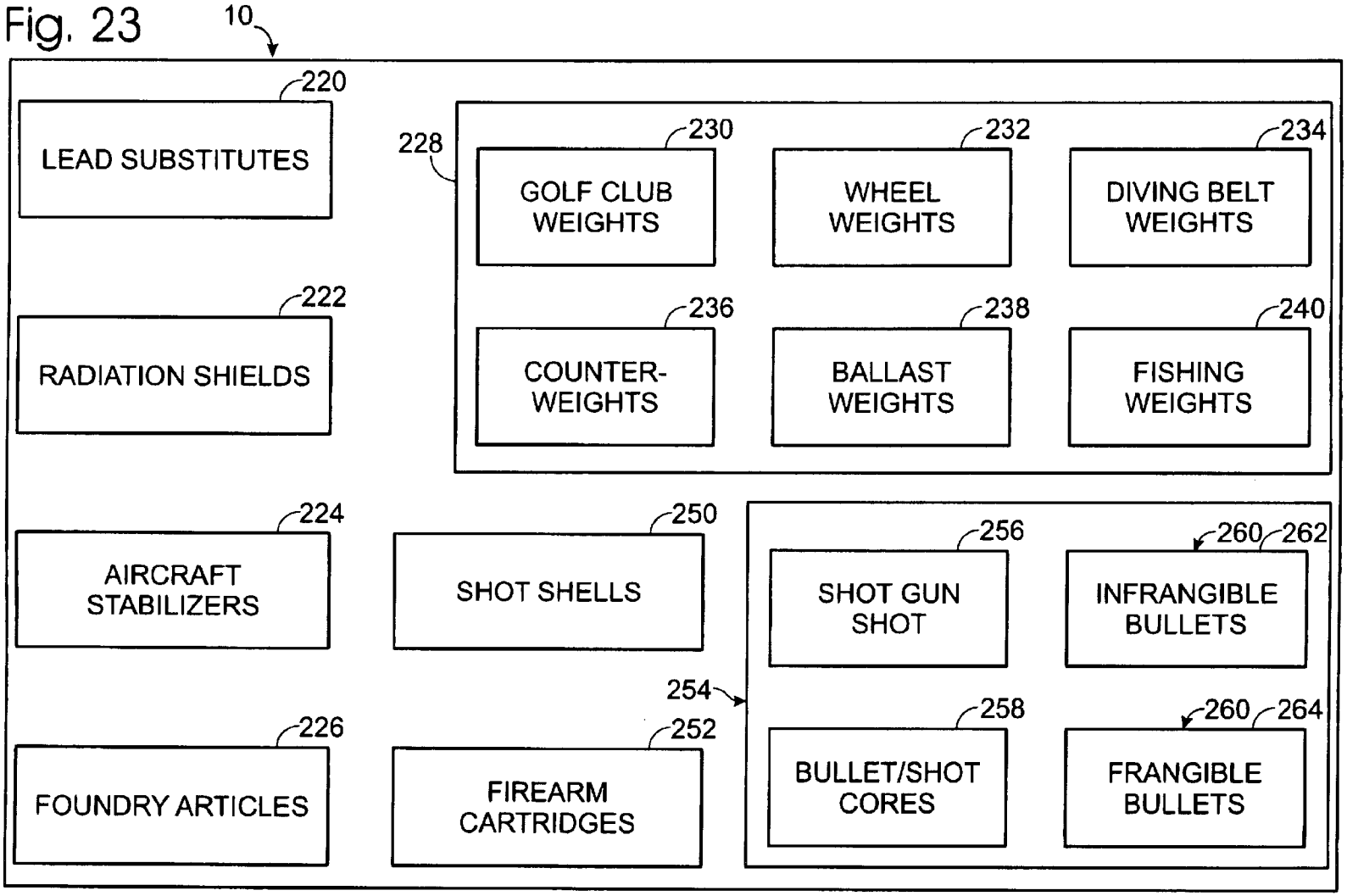
FIG. 23 is a schematic diagram showing illustrative examples of articles that may be formed from compacted intermediate structures according to the present invention.

As schematically shown in FIG. 23, illustrative examples of articles 10 that may be formed from compositions of matter 16 include lead substitutes 220, radiation shields 222, aircraft stabilizers 224, foundry articles 226, and weights 228, including golf weights 230, wheel weights 232, diving belt weights 234, counter-weights 236, ballast weights 238, and fishing weights 240. Composition of matter 16 may also be used to form shot shells 250, firearm cartridges 252, as well as other structures used to house a firearm projectile. As described in more detail herein, composition of matter 16 may also be used to form firearm projectiles 254, including shotgun shot 256, bullet/shot cores 258, and bullets 260, such as infrangible bullets 262, and frangible bullets 264.

A shot 256 according to the present invention is schematically illustrated in FIG. 24. Although illustrated as having a spherical configuration, it is within the scope of the invention that shot 256 may have non-spherical configurations as well. In solid lines, shot 256 is shown being completely formed from a composition of matter 16. Shot 256 may include a component that is formed from a material other than the composition of matter discussed herein. For example, and as indicated in fragmentary dashed lines in FIG. 24, shot 256 may include a core 272 that is at least substantially or completely formed from a composition of matter 16 according to the present invention and further includes a coating 274, such as a jacket 276.

In FIG. 25, an example of a shotgun shell constructed with shot 256 is shown and generally indicated at 280. Shell 280 includes a case or casing 282, which includes a wad 284, a charge 286 and a primer, or priming mixture, 288. In the illustrated embodiment, case or casing 282 encloses a plurality of shot 256. It is within the scope of the invention that shell 280 may include as few as a single projectile, which perhaps more appropriately may be referred to as a shot slug, and as many as dozens or hundreds of individual shots 256. It should be understood that the number of shot 256 in any particular shell will be defined by such factors as the size and geometry of shot 256, the size and shape of shell 280, the available volume to be filled by shot 256, etc. For example, a double ought (00) buckshot shell typically contains nine shots 256 having diameters of approximately 0.3 inches, while shells intended for use in hunting birds, and especially smaller birds, tend to contain many more shots 256.

In FIG. 26, an article 10 in the form of a firearm cartridge 290 housing a bullet 260 is shown. Cartridge 290 includes a case or casing 292. Casing 292 includes a cup 294, a charge 296 and a primer, or priming mixture, 298. Casing, primer and charge may be of any suitable materials. Cartridge 290 is ready to be loaded into a gun, such as a handgun, rifle or the like, and upon firing, discharges bullet 260 at high speeds and with a high rate of rotation. Although illustrated in FIG. 26 as a centerfire cartridge, in which primer 298 is located in the center of the base of casing 292, bullets according to the present invention may also be incorporated into other types of cartridges, such as a rimfire cartridge, in which the casing is rimmed or flanged and the primer is located inside the rim of the casing.

FIG. 27 shows an article 10 in the form of a golf club 292 constructed with golf club weight 230. Club 292 includes an elongate shaft 294, which typically includes a grip 296, and a head 298 with a face that is adapted to strike a golf ball. The shape and configuration of club 292 may vary, such as from a putter, to an iron, to a driver or other wood. Golf club weight 230 may be sized and positioned to produce a golf club with a desired swing characteristic.

FRANGIBLE AND/OR FERROMAGNETIC

Firearm projectiles 254 constructed according to the present invention may be either ferromagnetic or non-ferromagnetic, as discussed previously. Similarly, projectiles 254 may be frangible or infrangible. For example, in some applications it may be desirable for the projectile to be infrangible to increase the penetrating strength of the projectile. Alternatively, it may be desirable in other applications for the projectile to be frangible to decrease the penetrating strength and potential for ricochet of the projectile. For example, frangible projectiles may be desired when the projectiles will be used for target practice.

By "frangible," it is meant that the projectile is designed to remain intact during flight but to break into pieces upon impact with a relatively hard object. Frangible projectiles may also be referred to as non-ricocheting projectiles. Although it is within the scope of the present invention that projectile 254 is constructed, or designed, to break into several pieces upon impact, it is preferred that projectile 254 is at least substantially reduced to powder upon impact, and even more preferable that the projectile is completely reduced to powder upon impact. By "substantially reduced to powder" it is meant that at least 50% of the projectile (metallic powder 12 and binder 14) is reduced to powder. Preferably, at least 75% of the projectile and even more preferably at least 95% of the projectile is reduced to powder upon impact. Another exemplary construction for a frangible projectile is a projectile in which the resulting particles from the composition of matter forming the bullet (or core) each weigh less than 5 grains (0.324 grams). When the projectile or other article is frangible, it may be coated, painted, or plated to reduce particle loss during handling and machining. For example, a wax, epoxy or metal coating may be used.

Figure 28:
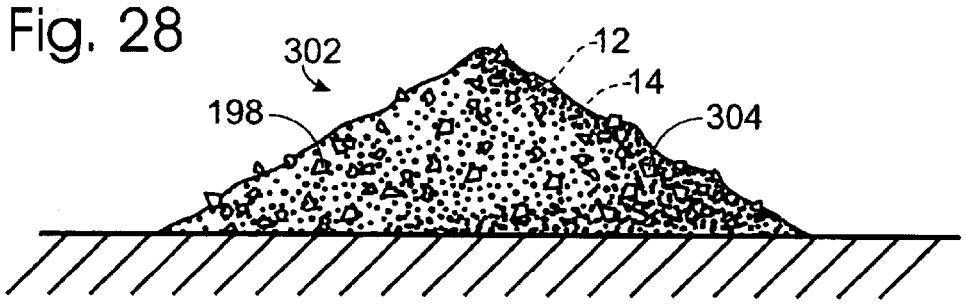
FIG. 28 is a schematic side elevation view showing a frangible embodiment of a bullet of the present invention after the bullet has been fired.
Figure 29:
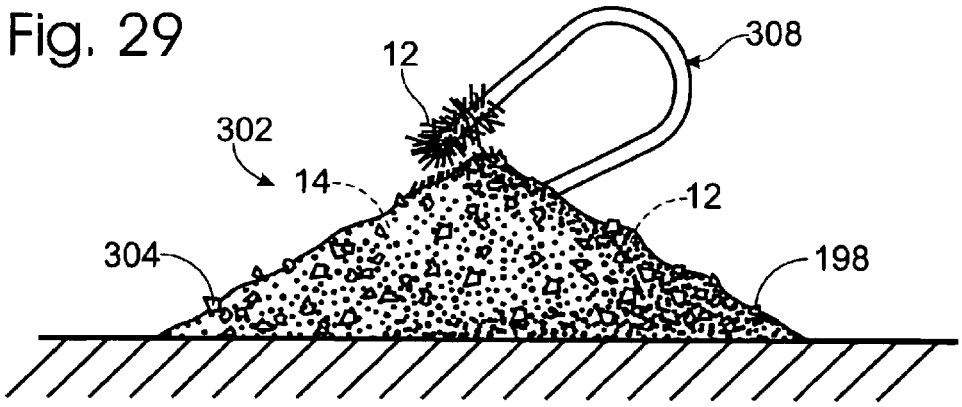
FIG. 29 is a schematic side elevation view showing a method for recovering ferromagnetic portions of the bullet of FIG. 28.

In FIG. 28, resultant powder 302 produced from a fired frangible jacketed bullet is shown. In FIG. 28, portions of a jacket 198 are visible in the resultant powder. In many applications, powder 302 may contain contaminants 304, such as portions of targets, debris and the like that are mixed with the powdered bullet when the powder is accumulated. In embodiments in which tungsten-containing powder 12 is selected to be ferromagnetic, such as by including ferrotungsten, the tungsten-containing powder 12 may be recovered from the resultant powder using a magnet 308, as somewhat schematically illustrated in FIG. 29. Similarly, magnets may be used to recover magnetic projectiles from bodies of water and from shooting ranges. Such a projectile may also be referred to as a recyclable projectile because it is easily reclaimed. Using a ferromagnetic tungsten-containing powder 12 also enables an easy determination, using a magnet, that the projectile is not formed from lead, which is not magnetic.

Although ferromagnetic powders may be desirable in some applications, it is within the scope of the present invention that tungsten-containing powders may be used that are not ferromagnetic or which do not produce a ferromagnetic composition of matter 16 in the concentration in which the powder is present.

INDUSTRIAL APPLICABILITY

The present invention is applicable to any powder metallurgy application in which powders containing tungsten and at least one binder are used to form articles, such as firearm projectiles, radiation shields, weights, and other lead substitutes.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Where the disclosure or subsequently filed claims recite "a" or "a first" element or the equivalent thereof, it should be within the scope of the present inventions that such disclosure or claims may be understood to include incorporation of one or more such elements, neither requiring nor excluding two or more such elements.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A tungsten-containing fire projectile, comprising:

a lead-free body at least substantially comprised of a compacted powder comprising at least a tungsten-containing component and a tin-containing component, wherein the body has a density in the range of 8 g/cc and 15 g/cc, and further wherein the compacted powder has an extrusion constant (k) of less than 30,000 pounds per square inch (psi), with the extrusion constant being defined by the equation $P=k \ln (A/A')$, with (P) representing the extrusion pressure in psi, (A) representing the cross-sectional area of a sample formed from the compacted powder before extrusion and (A') representing the cross-sectional area of the sample after extrusion.

2. The projectile of claim 1, wherein before compaction, the powder has an Hall flowmeter reading of less than 18 seconds for fifty grams of the powder flowing through a cone without tapping.

3. The projectile of claim 2, wherein before compaction, the powder has an Hall flowmeter reading of less than 16 seconds for fifty grams of the powder flowing through a cone without tapping.

4. The projectile of claim 2, wherein the compacted powder has an extrusion constant of less then 20,000 psi.

5. The projectile of claim 1, wherein the tin-containing component is at least substantially comprised of tin.

6. The projectile of claim 1, wherein the tungsten-containing component includes ferrotungsten.

7. The projectile of claim 1, wherein the tungsten-containing component includes an alloy of tungsten, nickel an iron.

8. The projectile of claim 1, wherein the body is unsintered.

9. The projectile of claim 1, wherein the powder further comprises at least one non-metallic binder.

10. The projectile of claim 9, wherein the at least one non-metallic binder includes a thermoset resin.

11. The projectile of claim 10, wherein the at least one non-metallic binder includes a flexible epoxy.

12. The projectile of claim 10, wherein the projectile further comprises a non-metallic coating on the body.

13. The projectile of claim 12, wherein the projectile further comprises a jacket that at least substantially encloses the body.

14. A firearm cartridge containing a firearm projectile according to claim 1.

15. The projectile of claim 1, wherein the projectile is frangible.

16. The projectile of claim 1, wherein the projectile is infrangible.

17. The projectile of claim 1, wherein the projectile is a bullet.

18. The projectile of claim 1, wherein the projectile is a shot pellet.

19. The projectile of claim 1, wherein the projectile is a shot slug.

20. The projectile of claim 1, wherein the projectile has a density in the range of 8–11.2 g/cc.

21. The projectile of claim 1, wherein the projectile has a density in the range of 11.1–11.3 g/cc.

22. The projectile of claim 1, wherein the projectile has a density in the range of 11.5–13 g/cc.

23. The projectile of claim 1, wherein the projectile has a density in the range of 12 g/cc–15 g/cc.

* * * * *

UNITED STATES PATENT AND TRADEMARK OFFICE

CERTIFICATE OF CORRECTION

PATENT NO. : 6,823,798 B2
DATED : November 30, 2004
INVENTOR(S) : Darryl D. Amick It is certified that error appears in the above-identified patent and that said Letters Patent is hereby corrected as shown below:

Column 28,
Line 24, after "A tungsten-containing" please delete "fire" and insert -- firearm -- therefor.
Line 32, after "defined by the equation" please delete "P=k In" and insert -- P=k ln -- therefor.
Lines 39 and 43, after "the powder has" please delete "an" and insert -- a -- therefor.

Signed and Sealed this

Nineteenth Day of April, 2005

JON W. DUDAS
*Director of the United States Patent and Trademark Office*